US008701222B2

(12) United States Patent
Shin et al.

(10) Patent No.: US 8,701,222 B2
(45) Date of Patent: Apr. 22, 2014

(54) SANITARY WASHING DEVICE

(75) Inventors: Kazuma Shin, Fukuoka-Ken (JP); Michinori Yananose, Fukuoka-Ken (JP); Hiroshi Nakamura, Fukuoka-Ken (JP); Shinji Okano, Fukuoka-Ken (JP); Osamu Tateishi, Fukuoka-Ken (JP)

(73) Assignee: Toto Ltd., Fukuoka (JP)

( * ) Notice: Subject to any disclaimer, the term of this patent is extended or adjusted under 35 U.S.C. 154(b) by 1124 days.

(21) Appl. No.: 12/600,196

(22) PCT Filed: May 14, 2008

(86) PCT No.: PCT/JP2008/058877

§ 371 (c)(1),
(2), (4) Date: Jan. 25, 2010

(87) PCT Pub. No.: WO2008/140105

PCT Pub. Date: Nov. 20, 2008

(65) Prior Publication Data

US 2010/0125941 A1 May 27, 2010

(30) Foreign Application Priority Data

| | | |
|---|---|---|
| May 15, 2007 | (JP) | 2007-129902 |
| Dec. 28, 2007 | (JP) | 2007-338919 |
| Jan. 28, 2008 | (JP) | 2008-016162 |
| Mar. 13, 2008 | (JP) | 2008-064548 |

(51) Int. Cl.
*A47K 3/26* (2006.01)

(52) U.S. Cl.
USPC ..... 4/443; 4/420.4; 4/447

(58) Field of Classification Search
USPC ..... 4/443, 444, 447, 420.4, 420.5
See application file for complete search history.

(56) References Cited

FOREIGN PATENT DOCUMENTS

| | | | |
|---|---|---|---|
| JP | 54-111130 | | 8/1979 |
| JP | 62-138767 | U | 9/1987 |
| JP | 03-028429 | | 2/1991 |
| JP | 6-010395 | A | 1/1994 |
| JP | 6-212679 | A | 8/1994 |
| JP | 7-38856 | | 7/1995 |
| JP | 09-119159 | | 5/1997 |
| JP | 2998519 | B2 | 1/2000 |
| JP | 2000-120136 | A | 4/2000 |
| JP | 2001-132048 | | 5/2001 |
| JP | 2001-132049 | A | 5/2001 |
| JP | 2001-152514 | A | 6/2001 |
| JP | 2001-303646 | A | 10/2001 |
| JP | 2002-061256 | A | 2/2002 |
| JP | 2002-061258 | A | 2/2002 |
| JP | 2002-235359 | A | 8/2002 |
| JP | 2002-286155 | A | 10/2002 |
| JP | 2003-342995 | A | 12/2003 |
| JP | 2007-146655 | A | 6/2007 |

*Primary Examiner* — Tuan N Nguyen
(74) *Attorney, Agent, or Firm* — Carrier Blackman & Associates, P.C.; Joseph P. Carrier; William D. Blackman

(57) ABSTRACT

A sanitary washing device includes: a water discharge nozzle configured to squirt water from a water discharge port; a first channel configured to guide water supplied from a water supply source to the water discharge nozzle; a first channel opening/closing valve provided in the first channel and configured to control passage of water through the first channel; a heat exchange unit provided in the first channel between the first channel opening/closing valve and the water discharge nozzle and configured to heat water passed therethrough; and a draining device configured to drain water in the heat exchange unit toward the water supply source.

11 Claims, 25 Drawing Sheets

SANITARY WASHING DEVICE

TECHNICAL FIELD

This invention relates to a sanitary washing device, and more particularly to a sanitary washing device for washing the "bottom" and the like of a user sitting on a sit-down toilet bowl.

BACKGROUND ART

A sanitary washing device retractably houses a water discharge nozzle for squirting wash water, and can be installed on a sit-down toilet bowl to wash user's "bottom" and the like with warm water. Such a sanitary washing device includes a water channel system therein. Hence, for maintenance and inspection purposes and for the purpose of avoiding freezing in cold climates, for instance, the water supply section of the sanitary washing device requires drainage. Patent Document 1 discloses a sanitary washing device including a water supply section which allows easy maintenance and inspection, such as cleaning of its strainer and water drainage.

Patent Document 1: JP-A-2001-132048 (Kokai)

DISCLOSURE OF INVENTION

Technical Problem

In the technique described in Patent Document 1, the water supply section needs to be manually operated to drain the sanitary washing device, causing the problem of cumbersome operation.

This invention provides a sanitary washing device which can be drained in accordance with the presence or absence of water supply from outside.

Technical Solution

According to an aspect of the invention, there is provided a sanitary washing device including: a water discharge nozzle configured to squirt water from a water discharge port; a first channel configured to guide water supplied from a water supply source to the water discharge nozzle; a first channel opening/closing valve provided in the first channel and configured to control passage of water through the first channel; a heat exchange unit provided in the first channel between the first channel opening/closing valve and the water discharge nozzle and configured to heat water passed therethrough; and a draining device configured to drain water in the heat exchange unit toward the water supply source.

EXPLANATION OF REFERENCE

Figure 1:
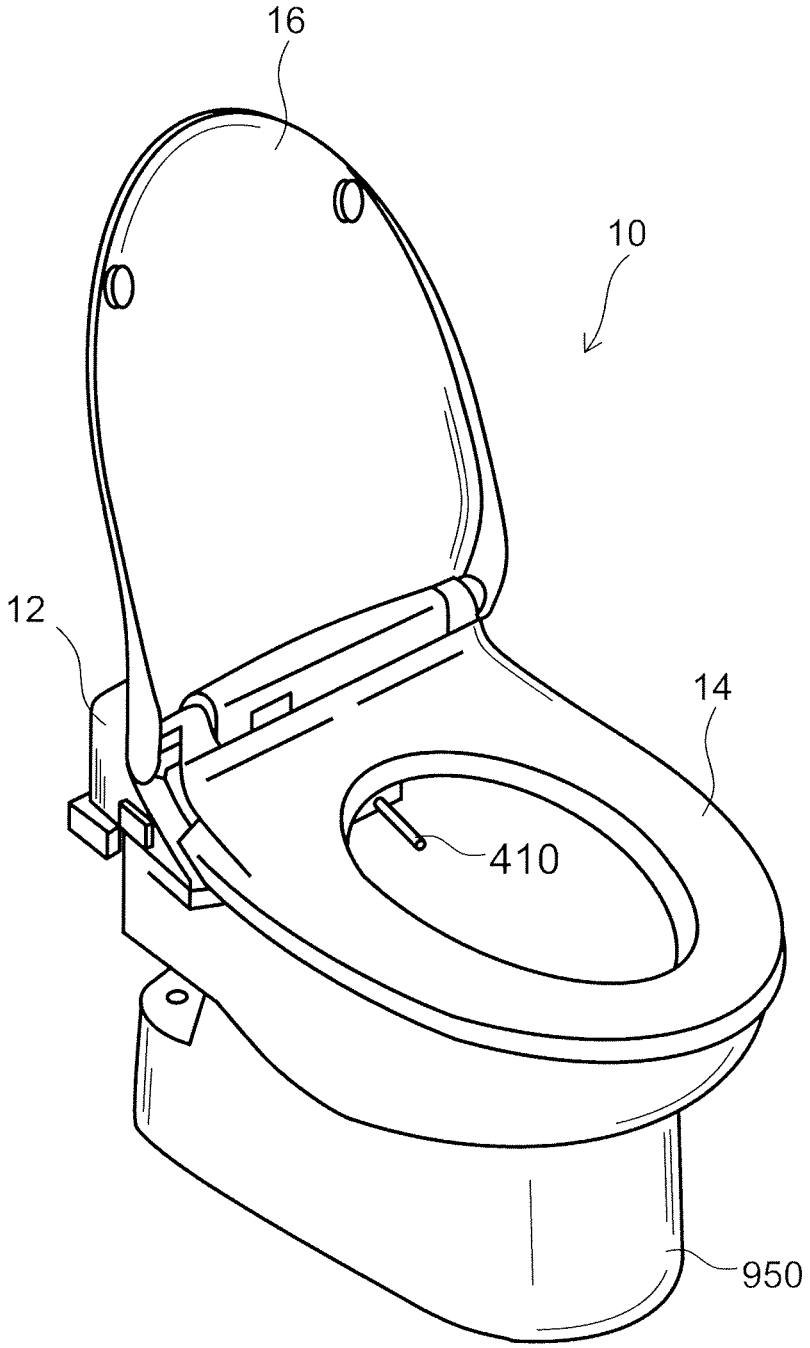
FIG. 1 is a schematic perspective view of a toilet device according to the embodiments of the invention.

10 sanitary washing device
12 main body section
14 toilet seat
16 toilet lid
20 water supply source
35 auxiliary power source
100 valve unit
102 water pressure sensor
110 first channel
112 water stopcock
114 strainer
120 solenoid opening/closing valve (solenoid valve)
130 pressure regulator valve
140 safety valve

150 second channel
160 opening/closing valve
172 housing
172A connection port
172R in-valve channel
172S seal surface
173 pressure receiver
173E peripheral portion
174 main valve
174S packing
175 spring
176A, 176B plate
177 nut
180 shutoff valve
190 normally open opening/closing valve
200 heat exchange unit
202 water level detecting device
210 vacuum breaker (pressure releasing device)
220 check valve
230 vacuum breaker (pressure releasing device)
240 normally closed opening/closing valve
250 channel selecting device
300 flow rate regulator valve unit (water stop valve)
400 nozzle unit
410 water discharge nozzle
412 water discharge port
480 nozzle motor
490 nozzle cleaning chamber
500 controlling section
550 supply detecting section
570 power source circuit
572 decision circuit
600 seating sensor
700 remote controller (manipulating section)
750 drainage operating section
950 toilet bowl

BEST MODE FOR CARRYING OUT THE INVENTION

Embodiments of the invention will now be described with reference to the drawings.

FIG. 1 is a schematic perspective view of a toilet device according to the embodiments of the invention.

This toilet device includes a sit-down toilet bowl 950 and a sanitary washing device 10 installed thereon. The sit-down toilet bowl 950 may be of the so-called "low-tank type", or may be a "direct-pressure type" device which is directly connected to a water supply source, such as waterworks, to flush wash water. Furthermore, with regard to the drainage mechanism of the toilet bowl 950, it may be a toilet of the so-called siphon type, a toilet which is drained by opening a drain valve, or a toilet of the "vacuum type" which drains water, waste and the like accumulated in the toilet bowl 950 to the negative pressure side by opening a drain valve.

The sanitary washing device 10 installed on the toilet bowl 950 is according to one of the first to eighth embodiment described below. More specifically, the sanitary washing device 10 includes a main body section 12, and a toilet seat 14 and a toilet lid 16 openably/closably and pivotally supported with respect to this main body section 12. However, the toilet lid 16 may be omitted. From the main body section 12, a water discharge nozzle 410 extends out into the bowl of the toilet bowl 950 in response to user's switch manipulation and the like, and water can be squirted from a water discharge port provided near its tip to wash user's "bottom" and the like. "Water" referred to herein includes not only cold water, but also heated water.

First Embodiment

Figure 2:
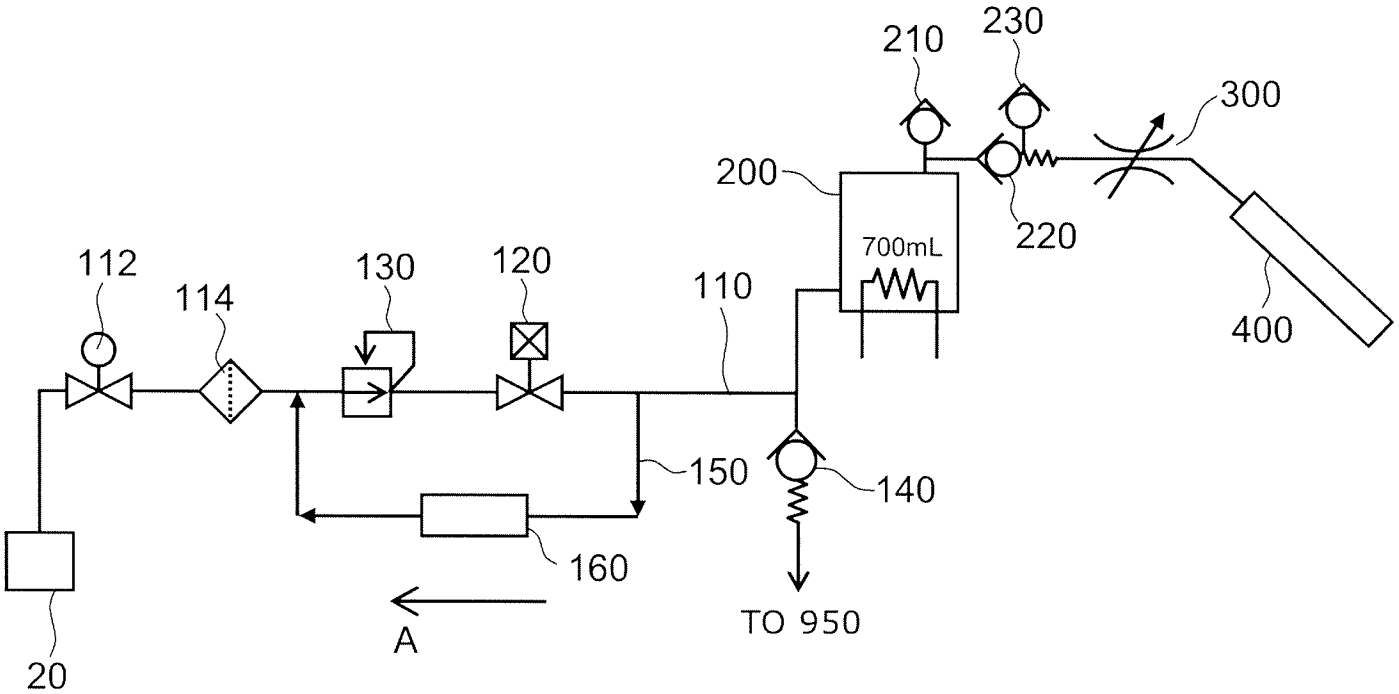
FIG. 2 is a block diagram showing the configuration of the water channel system of a sanitary washing device 10 of a first embodiment of the invention.

FIG. 2 is a block diagram showing the configuration of the water channel system of a sanitary washing device 10 of a first embodiment of the invention.

The sanitary washing device 10 includes a first channel 110 connected to a water supply source 20, such as waterworks and water storage tank, and led to a nozzle unit 400. On the upstream side of the first channel 110 is first provided a water stopcock 112. The water stopcock 112 is manually openable/closable, and can shut off the water channel whenever necessary on such occasions as installation/removal and maintenance/inspection of the sanitary washing device 10. Here, the water stopcock 112 may be provided in the sanitary washing device 10, or may be provided on the supply port side of the water supply source 20, such as waterworks, as an element separate from the sanitary washing device 10.

Downstream of the water stopcock 112, a strainer 114, a pressure regulator valve 130, and a solenoid opening/closing valve (first channel opening/closing valve) 120 are provided. The strainer 114 is illustratively a filter with approximately 80 mesh and removes foreign matter mixed in the supplied water. The pressure regulator valve 130 serves to regulate the water supply pressure, if it is high, to within a prescribed pressure range. The solenoid opening/closing valve 120 is illustratively a normally closed solenoid valve, that is, a solenoid valve which is closed when non-energized, and controls supply of water in accordance with commands from the controlling section (see FIG. 7).

A safety valve 140 is provided downstream of the solenoid opening/closing valve 120. The safety valve 140 is opened when the pressure of the water channel increases, and drains water to the bowl of the toilet bowl 950. The safety valve 140 thus provided can avoid water leakage inside the sanitary washing device 10 even if any failure of the pressure regulator valve 130, for instance, results in increasing the pressure of the water channel on its secondary side.

A heat exchange unit 200 is provided downstream of the safety valve 140. The heat exchange unit 200 heats the supplied water with a heater to turn it into warm water at a prescribed temperature. Downstream of the heat exchange unit 200, a vacuum breaker 210, a check valve 220, a vacuum breaker 230, a flow rate regulator valve unit (water stop valve) 300, and a nozzle unit 400 are connected. The check valve 220 prevents backflow of water from the nozzle unit 400 to the water channel when, for instance, the pressure of the water channel decreases. The vacuum breakers 210, 230 provided thereacross take in air from outside at the time of draining the water channel to facilitate draining the water channel on the primary side and secondary side of the check valve 220. The flow rate regulator valve unit 300 regulates opening/closing and switching of water supply to the water discharge nozzle and nozzle cleaning chamber (see FIG. 7) provided in the nozzle unit 400, and adjustment of the force of water. A pulsator unit for pulsating water, for instance, may be provided on the secondary side of the flow rate regulator valve unit 300.

This embodiment allows the flow rate regulator valve unit 300 to shut off the first channel 110. This can prevent water from being drained from the tip of the water discharge nozzle 410 when the water discharge nozzle 410 (see FIG. 1) provided in the nozzle unit 400 is not in use.

Furthermore, this embodiment further includes a second channel 150 bypassing part of the first channel 110 described above, and this second channel 150 is provided with an opening/closing valve (second channel opening/closing valve) 160. In the embodiment shown in FIG. 2, the second channel 150 couples between the primary side (upstream side) of the pressure regulator valve 130 and the secondary side (downstream side) of the solenoid opening/closing valve 120 in the first channel 110. Here, the connecting position of the second channel 150 is not limited to the example shown in FIG. 2, but it may be connected to the primary side of the strainer 114, for instance. Alternatively, the second channel 150 may be connected to the secondary side of the safety valve 140, for instance.

The opening/closing valve 160 provided in the second channel 150 is closed when the water pressure on its primary side (nearer to the water supply source) is high, and is opened when the water pressure on the primary side is low. The opening/closing valve 160 can be a pressure-responsive opening/closing valve which transitions to the closed state when it receives water pressure of a prescribed value or more from the primary side. That is, if the water pressure supplied from the water supply source 20 has a prescribed value or more, the opening/closing valve 160 is closed, and the second channel 150 is shut off. Hence, the water supplied from the water supply source 20 is supplied through the first channel 110 to the nozzle unit 400, enabling normal operation of the sanitary washing device 10.

On the other hand, if the water pressure supplied from the water supply source 20 decreases, the opening/closing valve 160 is opened. Then, the primary side and the secondary side of the solenoid opening/closing valve 120 are allowed to communicate. That is, as shown by arrow A in FIG. 2, water can be drained from the secondary side of the solenoid opening/closing valve 120 of the first channel 110 through the second channel 150 to the primary side of the solenoid opening/closing valve 120 of the first channel 110. Hence, the water left in the section from the secondary side of the solenoid opening/closing valve 120 to the check valve 220 can be drained toward the water supply source 20 through the second channel 150. For instance, in the case where the heat exchange unit 200 is provided with a hot water storage tank, approximately 700 milliliters of water may be left. According to this embodiment, such residual water can be reliably and readily drained through the second channel 150. Here, the invention is not limited to those provided with a hot water storage tank, but also encompasses those provided with a heat exchanger of the so-called instantaneous heating type.

In this embodiment, the second channel 150 is connected between the primary side of the pressure regulator valve 130 and the secondary side of the solenoid opening/closing valve 120. This allows the primary pressure from the water supply source 20 and the secondary pressure reduced by the pressure regulator valve 130 to be applied to the opening/closing valve 160. Hence, the pressure difference therebetween can be used to operate the opening/closing valve 160 more reliably and smoothly.

The water left on the secondary side of the check valve 220 is drained as needed from the water discharge port of the nozzle unit 400, for instance, to the bowl of the toilet bowl 950. At this time, the vacuum breaker 230 takes in air, which facilitates drainage.

According to this embodiment, irrespective of the presence or absence of power supply to the sanitary washing device 10, the water left in the water channel of the sanitary washing device 10 can be drained toward the water supply source 20 when the water pressure of the water supply source 20 decreases. That is, water drainage can be performed using the existing water supply pipe without need of user's drainage operation and without need of providing a special drainage mechanism.

For instance, in cold climates, when water supply to the sanitary washing device 10 is stopped, or when water is drained for the purpose of avoiding freezing of the water supply source 20, drainage of the sanitary washing device 10 can be automatically performed in response to the decrease of water supply pressure. That is, the user does not need to purposely manipulate the water stop valve and the drain valve of the sanitary washing device, but only needs to stop or drain the water supply source. Thus, this embodiment can provide a user-friendly sanitary washing device.

Furthermore, for instance, when a camper, train, airplane or the like with the sanitary washing device installed therein is parked in a low-temperature environment, the water supply source is stopped, and the power supply is often stopped as well. According to this embodiment, even in such cases, drainage of the sanitary washing device can be automatically performed in response to the decrease of the water pressure of the water supply source. Hence, also in these cases, the user does not need to purposely manipulate the water stop valve and the drain valve of the sanitary washing device, but only needs to stop or drain the water supply source. Thus, this embodiment can provide a user-friendly sanitary washing device.

Figure 3:
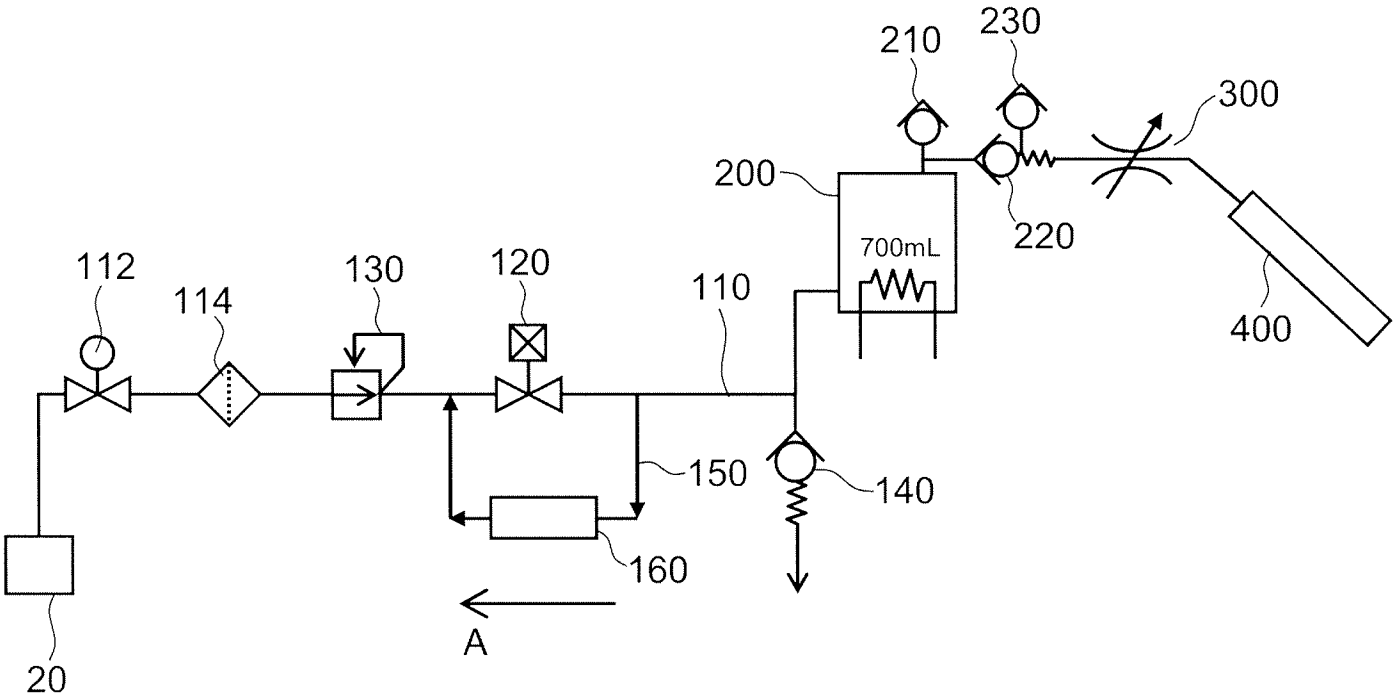
FIG. 3 is a block diagram showing a variation of the sanitary washing device 10 of this embodiment.

FIG. 3 is a block diagram showing a variation of the sanitary washing device 10 of this embodiment.

In this variation, the second channel 150 is connected between the pressure regulator valve 130 and the solenoid opening/closing valve 120. For instance, if drainage from the primary side to the secondary side of the pressure regulator valve 130 is good, drainage throughout the first channel 110 can be smoothly performed in accordance with the example described above with reference to FIG. 2. On the other hand, if drainage from the primary side to the secondary side of the pressure regulator valve 130 is not very good, but drainage from the secondary side to the primary side is good, then drainage on the secondary side of the solenoid opening/closing valve 120 can be reliably performed in accordance with the variation shown in FIG. 3.

Figure 4:
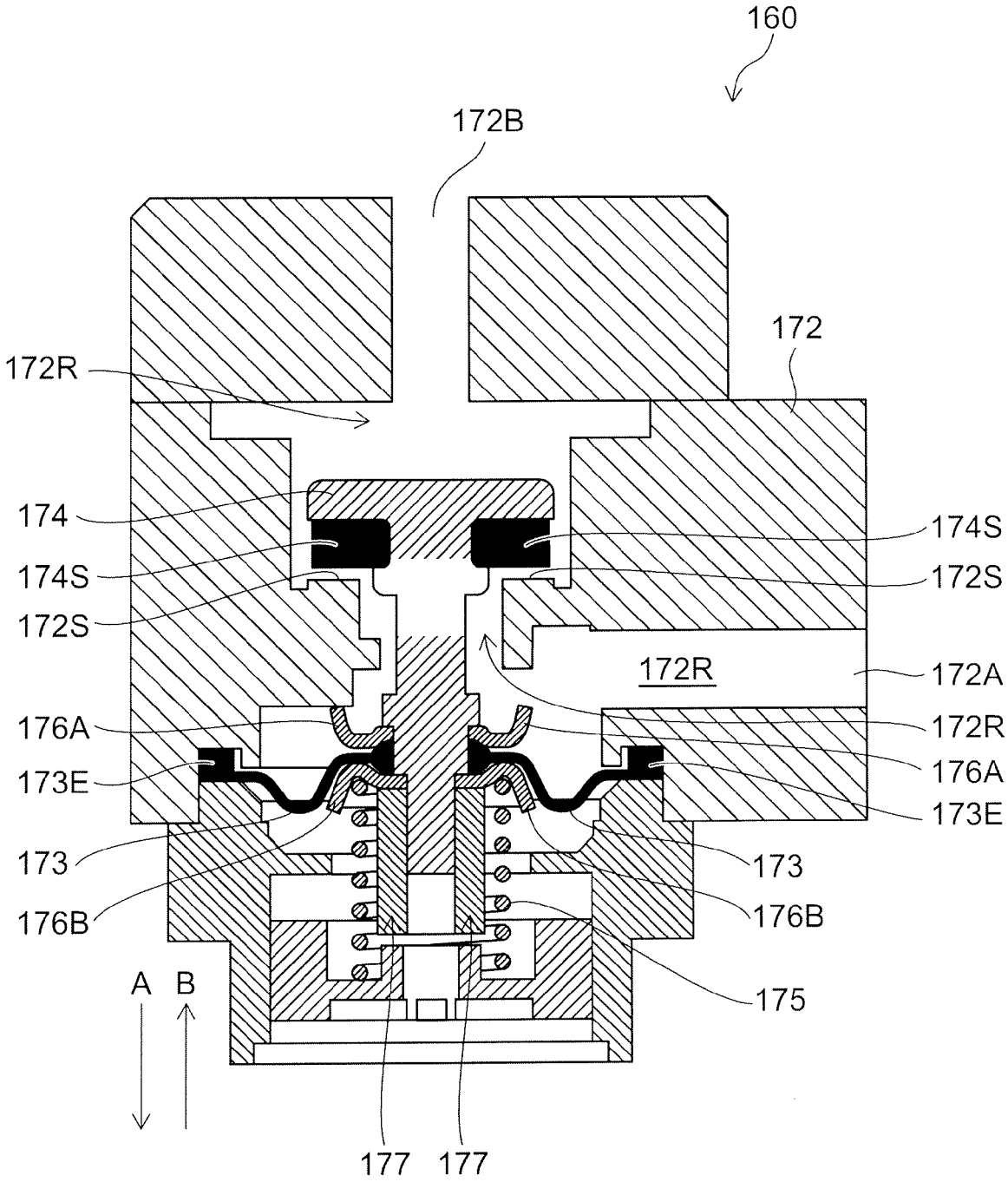
FIG. 4 is a schematic cross-sectional view illustrating the structure of an opening/closing valve 160 which can be used in this embodiment.

FIG. 4 is a schematic cross-sectional view illustrating the structure of an opening/closing valve 160 which can be used in this embodiment.

The opening/closing valve 160 of this example includes a housing 172, a pressure receiver 173 housed therein, and a main valve 174 connected to the pressure receiver 173 and supported so as to be movable in the direction of arrows A and B in the figure. The pressure receiver 173 is illustratively shaped like a generally toroidal diaphragm. The peripheral portion 173E of the pressure receiver 173 is fixed liquid-tight to the housing 172. On the other hand, the vicinity of the center of the pressure receiver 173 is vertically sandwiched by plates 176A, 176B and fixed to the main valve 174 with a nut 177. That is, the pressure receiver 173 supports the main valve 174 so that the main valve 174 can move in the direction of arrows A and B with the periphery of the pressure receiver 173 supported by the housing 172.

On the other hand, the housing 172 includes a first connection port 172A connected to the primary side of the solenoid opening/closing valve 120 and a second connection port 172B connected to the secondary side of the solenoid opening/closing valve 120. In the housing 172 is formed an in-valve channel 172R which allows the first connection port 172A and the second connection port 172B to communicate.

The in-valve channel 172R can be opened/closed by the main valve 174. The main valve 174 is provided with a packing 174S for liquid-tightly sealing the portion abutting the seal surface 172S of the housing 172. FIG. 4 shows the state where the main valve 174 is opened by moving in the direction of arrow B. That is, the packing 174S of the main valve 174 is separated from the seal surface 172S of the housing 172. In this state, the in-valve channel 172R is opened. Furthermore, the main valve 174 is biased by a spring 175 in the direction of arrow B.

On the other hand, the diaphragm-shaped pressure receiver 173 is provided so that one surface thereof is exposed to the in-valve channel 172R in the housing. The other surface of the pressure receiver 173 is opened to the atmosphere side. That is, the pressure receiver 173 is provided as an element constituting part of the in-valve channel 172R. When water flows into the in-valve channel 172R, the differential pressure between the pressure of water in the in-valve channel 172R and the atmospheric pressure is applied to the pressure receiver 173.

FIG. 5 is a schematic view for illustrating the operation of the opening/closing valve 160.

Figure 5A:
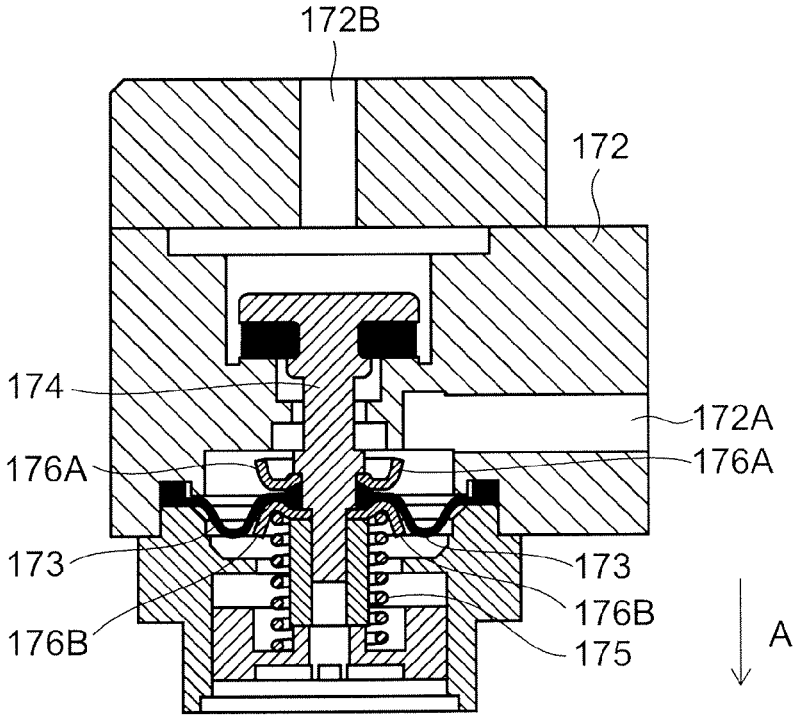
FIGS. 5A and 5B are schematic views for illustrating the operation of the opening/closing valve 160.

FIG. 5A shows the state where a prescribed water pressure is applied to the first connection port 172A. More specifically, this corresponds to the case where a prescribed water pressure is supplied from the water supply source 20 in the example described above with reference to FIGS. 2 and 3. Here, by the differential pressure between the water pressure supplied from the water supply source 20 and the atmospheric pressure, the pressure receiver 173 moves the main valve 174 in the direction of arrow A against the biasing force of the spring 175. Then, the packing 174S of the main valve 174 is brought into pressure contact with the seal surface 172S of the housing. Consequently, the in-valve channel 172R is closed, and the second channel 150 is shut off. That is, as described above with reference to FIGS. 2 and 3, the normal operating state is realized, and the water supplied from the water supply source 20 is supplied through the first channel 110 to the nozzle unit 400. The water pressure required for the main valve 174 to shut off the in-valve channel 172R only needs to correspond to the water pressure required for operation of the sanitary washing device 10, and can be set to approximately 0.05 megapascals (MPa), for instance.

Figure 5B:
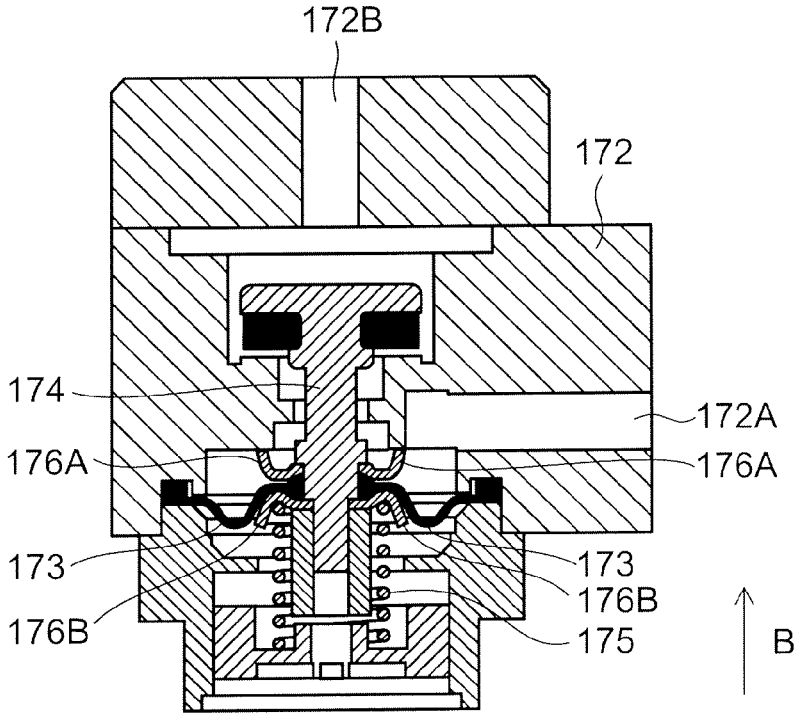

On the other hand, FIG. 5B shows the case where the supplied water pressure is decreased. More specifically, if the water pressure supplied from the water supply source 20 decreases, the differential pressure applied to the pressure receiver 173 with respect to the atmospheric pressure decreases. Then, the main valve 174 moves in the direction of arrow B by the biasing force of the spring 175. Then, the in-valve channel 172R is opened. Consequently, the second channel 150 described above with reference to FIGS. 2 and 3 is opened. That is, if the supplied water pressure decreases, the second channel 150 is automatically opened, and the water in the water channel up to the check valve 220 (see FIGS. 2 and 3) can be drained toward the water supply source 20.

FIG. 6 is a schematic view showing an example of the opening/closing valve 160.

Figure 6A:
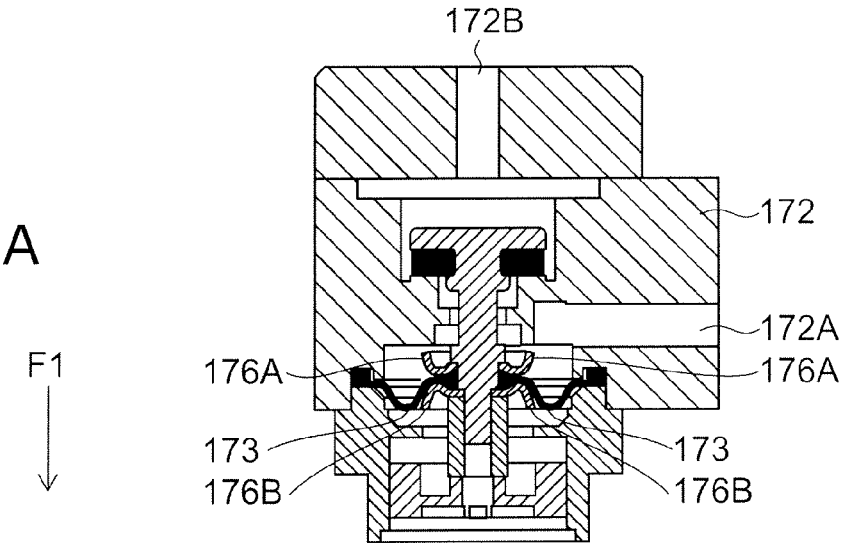
FIGS. 6A to 6C are schematic views showing an example of the opening/closing valve 160.

FIG. 6A shows the state where the spring 175 is removed. In this example, for instance, the pressure receiver 173 can be formed from a diaphragm illustratively made of rubber, and configured so that the main valve 174 is closed by the elastic force F1 of the pressure receiver 173 when no biasing force is applied by the spring 175.

Figure 6B:
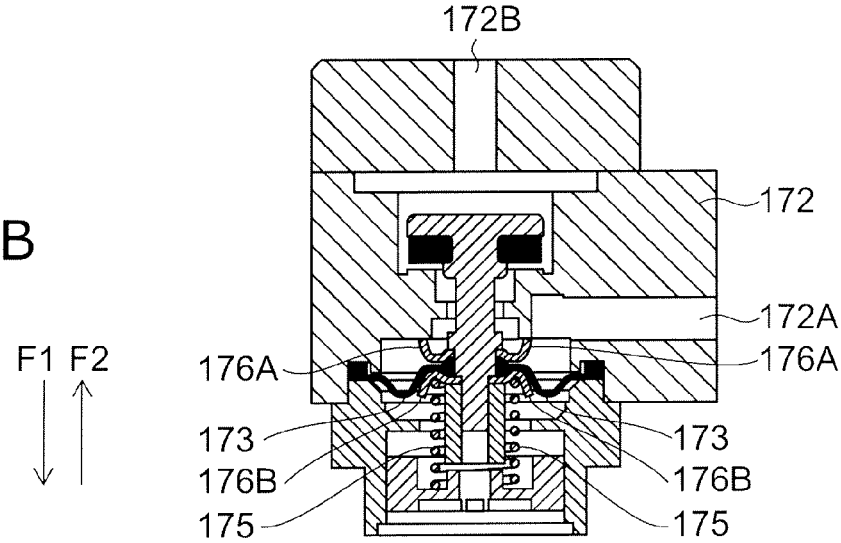

On the other hand, FIG. 6B shows the state where the spring 175 is provided. The biasing force F2 of the spring 175 acts on the pressure receiver 173. If the biasing force F2 of the spring 175 is larger than the elastic force (reaction force) F1 of the pressure receiver 173, the main valve 174 is closed as shown in FIG. 6B.

Figure 6C:
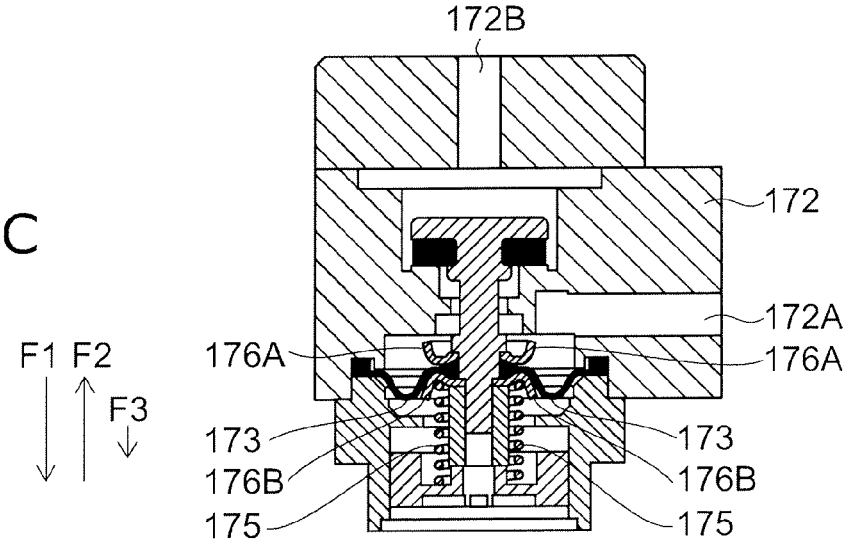

FIG. 6C shows the state where water is supplied to the in-valve channel 172R. When water is supplied to the in-valve channel 172R, the force F3 due to the differential pressure between this water pressure and the atmospheric pressure acts on the pressure receiver 173. This force F3 corresponds to the product of the differential pressure acting on the pressure receiver 173 and the pressure-receiving area of the pressure receiver 173. If the sum of the elastic force (reaction force) F1 of the pressure receiver 173 and the force F3 due to the differential pressure is larger than the biasing force F2 of the spring 175, the main valve 174 can be closed as shown in FIG. 6C.

Here, when the main valve 174 is closed, the pressure receiver 173 is subjected to a water pressure in the direction of closing the main valve 174. However, the packing 174S of the main valve 174 is subjected to a water pressure in the direction of opening the main valve 174. Hence, in evaluating the force F3, the pressure-receiving area of the main valve 174 in the closed state of the main valve 174 may be subtracted from the evaluation.

According to the result of prototyping by the inventor, the balance between the elastic force (reaction force) F1 of the pressure receiver 173 and the elastic force F2 of the spring 175 can be adjusted so that the main valve 174 can be stably closed when the water pressure in the in-valve channel 172R is approximately 8 kilopascals, for instance. That is, the main valve 174 can be reliably closed by a minute water pressure.

This embodiment is not limited to these examples. For instance, it is also possible to use only the elastic force of the pressure receiver 173 without providing the spring 175 so that the main valve 174 can be opened when the water pressure is a prescribed value or less. Alternatively, an elastic force in the direction of opening the main valve 174 can be applied by the pressure receiver 173, whereas a biasing force in the direction of closing the main valve 174 can be applied by the spring 175. The balance therebetween can be adjusted so that the main valve 174 can be opened when the water pressure in the in-valve channel 172R is a prescribed value or less.

Thus, the opening/closing valve 160 described above with reference to FIGS. 4 to 6 allows the second channel 150 to be opened/closed without using an electrical water pressure sensor or a solenoid opening/closing valve, for instance. That is, independent of stoppage of power supply to the sanitary washing device 10 or power failure, drainage of the sanitary washing device 10 can be reliably and readily performed.

Furthermore, the opening/closing valve 160 of this embodiment can reliably close the main valve 174 by the water pressure applied to the first connection port 172A. That is, advantageously, flow of water through the in-valve channel 172R is not necessarily needed, but the main valve 174 can be reliably closed if water pressure is applied to the first connection port 172A.

Next, an example of shutting off the first channel 110 using the flow rate regulator valve unit 300 is described.

Figure 7:
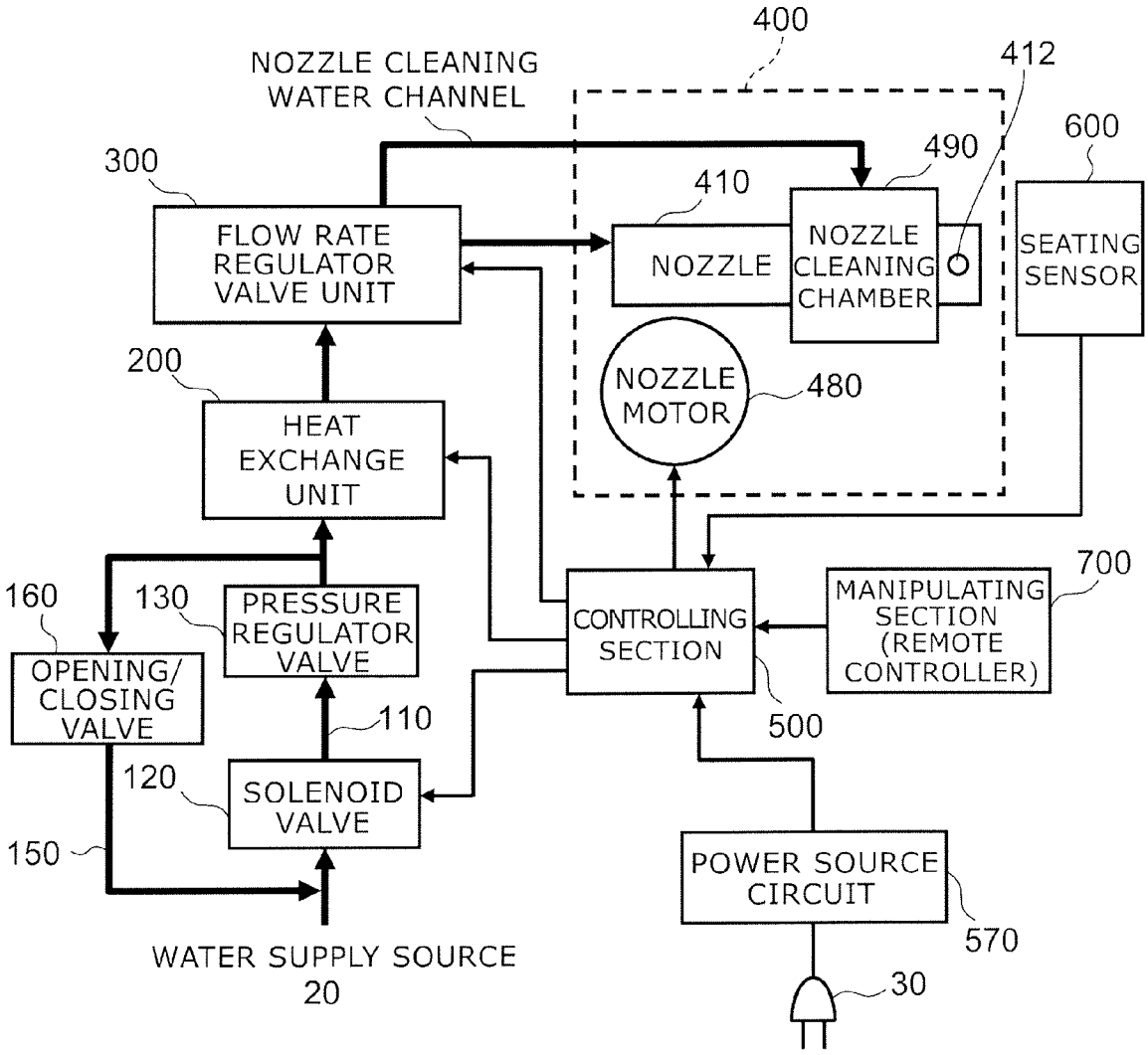
FIG. 7 is a block diagram of a sanitary washing device according to this embodiment.

FIG. 7 is a block diagram of a sanitary washing device according to this embodiment.

In this figure, elements similar to those described above with reference to FIGS. 1 to 6 are labeled with like reference numerals, and the detailed description thereof is omitted.

As described above with reference to FIGS. 2 and 3, the first channel 110 is provided with a pressure regulator valve 130, a solenoid valve 120, a heat exchange unit 200, a flow rate regulator valve unit 300, and a nozzle unit 400. The water stopcock 112, the strainer 114, the vacuum breakers 210, 230, the safety valve 140, the check valve 220 and the like described above with reference to FIGS. 2 and 3 can also be provided as needed.

The nozzle unit 400 includes a water discharge nozzle 410, a nozzle motor 480 for extending/retracting it, and a nozzle cleaning chamber 490 for squirting water to the outer periphery of the water discharge nozzle 410 to clean its body. The operation of these elements is controlled by a controlling section 500. The controlling section 500 receives as input a signal from a seating sensor 600 for detecting that a user is seated on the toilet seat 14, and information of switch manipulation by a remote controller and the like.

This embodiment prevents water from flowing out of the water discharge port 412 of the water discharge nozzle 410 when the water discharge nozzle 410 is not in use.

For instance, from any cause, the water pressure supplied from the water supply source 20 may be lower than a normal pressure, and the main valve 174 of the opening/closing valve 160 may fail to be completely closed. If the main valve 174 of the opening/closing valve 160 is not completely closed, water is supplied to the heat exchange unit 200 and the flow rate regulator valve unit 300 through the second channel 150 even if the solenoid valve 120 is closed. In such cases, if the flow rate regulator valve unit 300 is opened, water may flow out of the water discharge port 412 of the water discharge nozzle 410, for instance. That is, when the sanitary washing device 10 is not powered on, or when water discharge from the water discharge nozzle 410 is not performed, water may be drained from the water discharge port 412 of the water discharge nozzle 410.

Thus, in this embodiment, the channel on the primary side of the water discharge nozzle 410 and the nozzle cleaning chamber 490 is shut off when water discharge from the water discharge nozzle 410 and nozzle cleaning in the nozzle cleaning chamber 490, for instance, are not performed. Specifically, for instance, a shutoff valve can be provided either before or after the flow rate regulator valve unit 300 so that the controlling section 500 can close this shutoff valve when water discharge from the water discharge nozzle 410 and nozzle cleaning in the nozzle cleaning chamber 490, for instance, are not performed.

Alternatively, the channel can be closed in the flow rate regulator valve unit 300 when water discharge from the water discharge nozzle 410 and nozzle cleaning in the nozzle cleaning chamber 490, for instance, are not performed. This example is described below.

Figure 8:
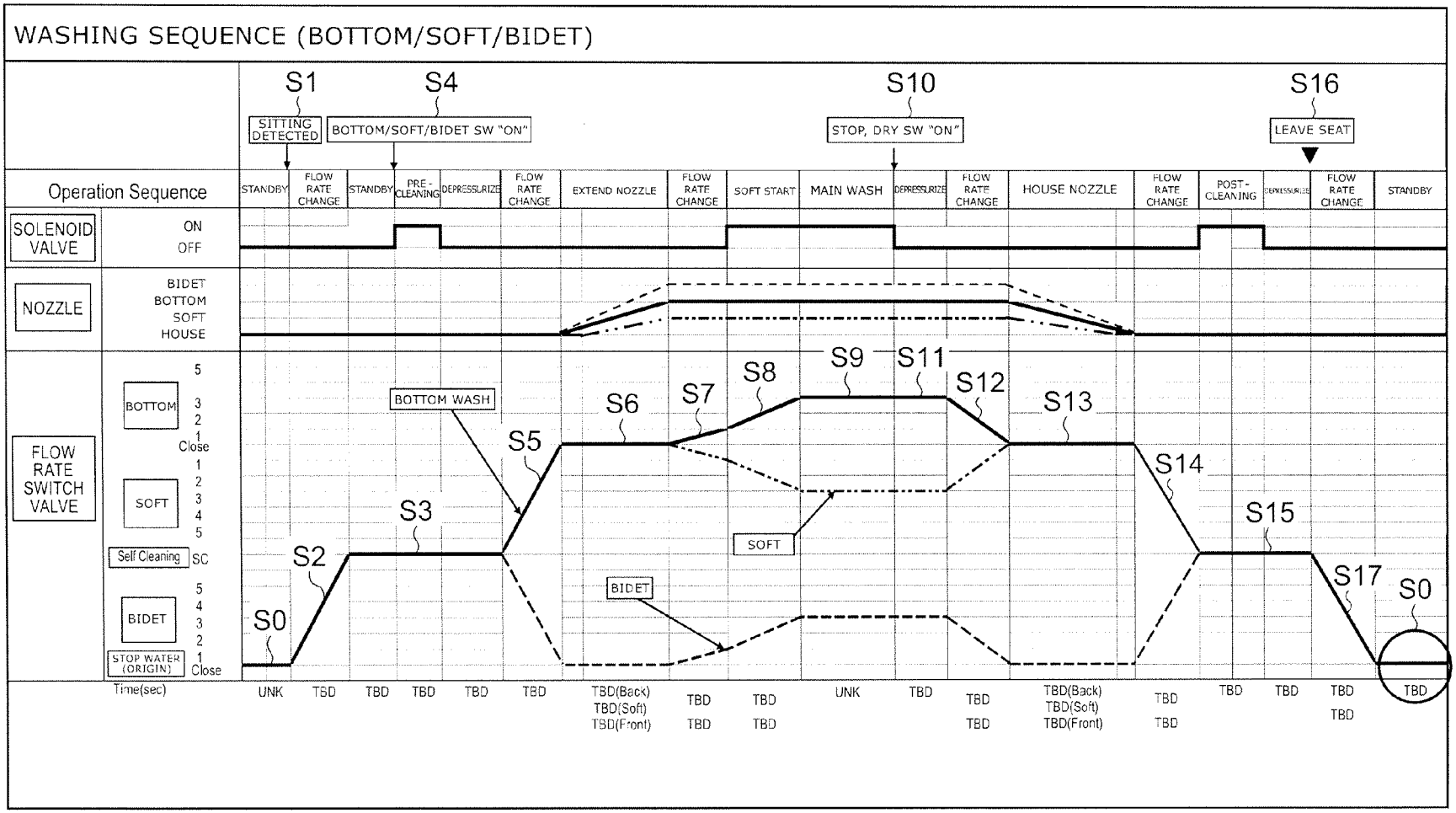
FIG. 8 is a timing chart illustrating the operation performed in the sanitary washing device 10 of this embodiment.

FIG. 8 is a timing chart illustrating the operation performed in the sanitary washing device 10 of this embodiment. FIG. 8 shows the state of the solenoid valve 120, the state of water discharge from the water discharge nozzle 410, and the operating state of the flow rate regulator valve unit 300.

In this embodiment, when the sanitary washing device 10 is not powered on, and when it is powered on and the seating sensor 600 (FIG. 7) has not detected user's seating, the flow rate regulator valve unit 300 is closed. That is, the channel to the water discharge nozzle 410 and the nozzle cleaning chamber 490 is shut off. On the other hand, when the sanitary washing device 10 is powered on and the seating sensor 600 (FIG. 7) has detected user's seating, the flow rate regulator valve unit 300 opens the channel to the water discharge nozzle 410 and the nozzle cleaning chamber 490 as needed, and regulates the flow rate of water supplied thereto.

The example shown in FIG. 8 is described. In the standby state, the flow rate regulator valve unit 300 is closed (S0). That is, the channel to the water discharge nozzle 410 and the nozzle cleaning chamber 490 is shut off.

When the seating sensor 600 detects user's seating (S1), the flow rate regulator valve unit 300 opens the channel and regulates the flow rate (S2), and self-cleaning of the water discharge nozzle 410 in the nozzle cleaning chamber 490 is performed (S3). Here, when the user seated on the toilet seat manipulates switches on the remote controller 700 (see FIG. 7) such as "BOTTOM", "SOFT", and "BIDET" (S4), the flow rate regulator valve unit 300 shuts off the channel after self-cleaning (S5). Then, after the water discharge nozzle 410 is advanced to a prescribed position (S6), the flow rate is regulated to a prescribed value (S7). The solenoid valve 120 is opened to start water discharge, and the flow rate is further regulated (S8), which is followed by water discharge at a prescribed flow rate (S9).

When the user manipulates a "STOP" or "DRY" switch on the remote controller 700 (S10), the solenoid valve 120 is closed to decrease the pressure of water in the channel (S11), and the flow rate regulator valve unit 300 shuts off the channel (S12). After the water discharge nozzle 410 is housed (S13), the flow rate regulator valve unit 300 regulates the flow rate (S14), and self-cleaning of the water discharge nozzle 410 in the nozzle cleaning chamber 490 is performed (S15).

Here, when the user stands up from the toilet seat and the seating sensor 600 indicates an undetected condition (S16), the flow rate regulator valve unit 300 shuts off the channel (S17) and enters the standby state (S0). That is, the channel to the water discharge nozzle 410 and the nozzle cleaning chamber 490 is shut off.

As described above, according to this embodiment, in the state of no water discharge from the water discharge nozzle 410 and the nozzle cleaning chamber 490, the flow rate regulator valve unit 300 shuts off the channel 110. This can reliably prevent water flowing through the second channel 150 from being drained from the water discharge nozzle 410 and the nozzle cleaning chamber 490 even if, for instance, from any cause, the water pressure supplied from the water supply source 20 is lower than a normal pressure so that the main valve 174 of the opening/closing valve 160 is not completely closed.

In this embodiment, the channel 110 is closed by the flow rate regulator valve unit 300. Hence, when supply of water from the water supply source 20 is started, water is less likely to flow also to the opening/closing valve 160 provided in the second channel. In contrast, the opening/closing valve 160 described above with reference to FIGS. 4 to 6 does not need flow of water, but the main valve 174 is reliably closed only by water pressure applied to the first connection port 172A. That is, even if the channel 110 is closed by the flow rate regulator valve unit 300, the opening/closing valve 160 of the second channel 150 can be reliably closed in response to water supply.

In the examples described above, the flow rate regulator valve unit 300 is used to shut off the first channel 110. However, the invention is not limited thereto. More specifically, as described above, a shutoff valve separate from the flow rate regulator valve unit 300 can be used as a water stop valve to shut off the channel led to the water discharge nozzle 410 and the nozzle cleaning chamber 490, and also in this case, a similar operation and effect can be achieved. This is also encompassed within the scope of the invention.

Second Embodiment

Next, a second embodiment of the invention is described.

Figure 9:
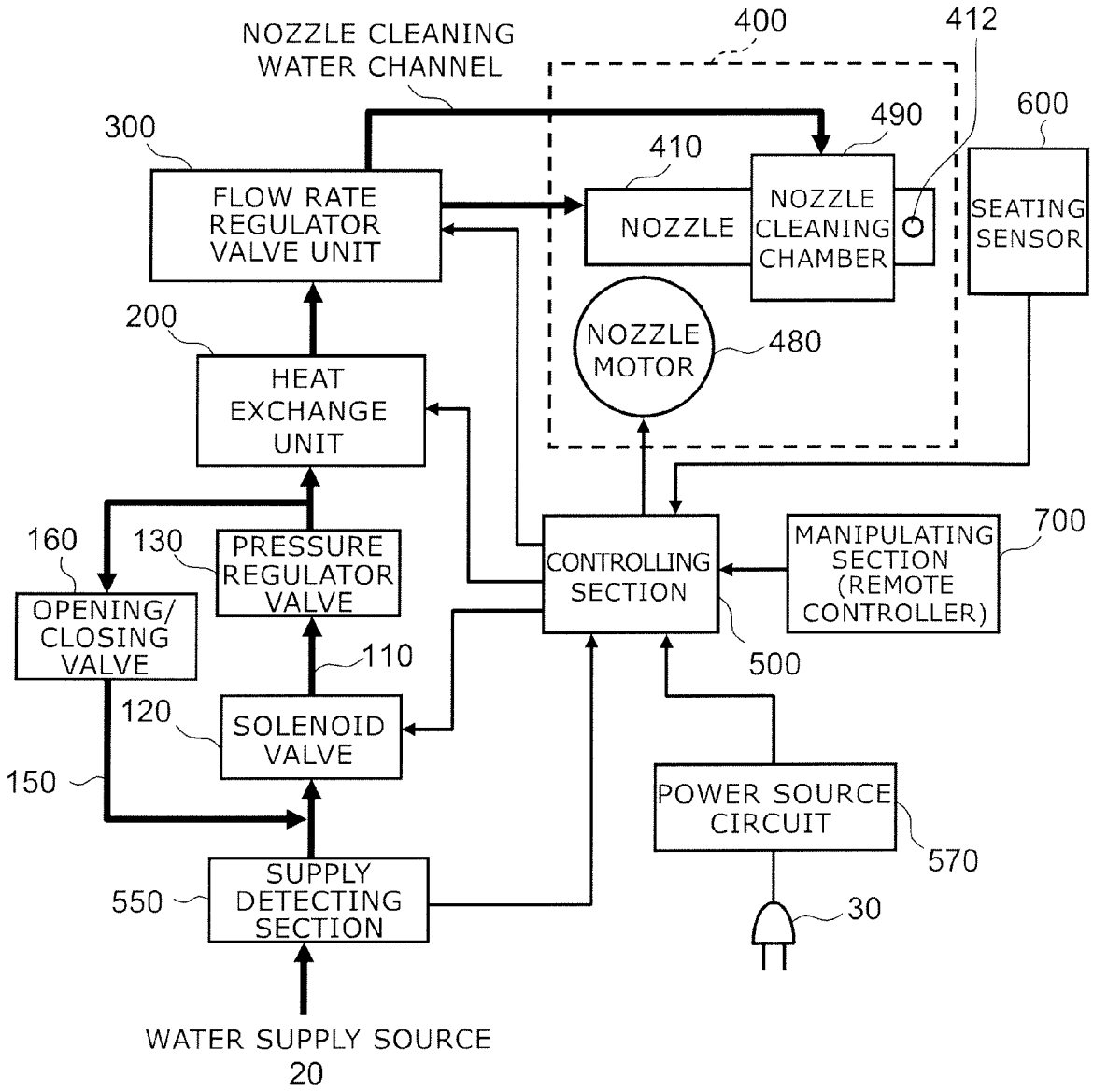
FIG. 9 is a block diagram of a sanitary washing device according to a second embodiment of the invention.

FIG. 9 is a block diagram of a sanitary washing device according to the second embodiment of the invention. Also in this figure, elements similar to those described above with reference to FIGS. 1 to 8 are labeled with like reference numerals, and the detailed description thereof is omitted.

In this embodiment, a supply detecting section 550 is provided in the first channel 110 so that the state of water supply to the sanitary washing device 10 can be detected. Specifically, the supply detecting section 550 can illustratively be a water pressure sensor which can detect the primary pressure supplied from the water supply source 20. However, the supply detecting section 550 is not limited to a water pressure sensor, and its position is not limited to the primary side of the solenoid valve 120. That is, it only needs to be able to detect the state of water supply to the sanitary washing device 10. The controlling section 500 can determine the state of water supply to the sanitary washing device 10 in accordance with a signal from the supply detecting section 550.

Also in this embodiment, a second channel 150 providing a bypass between the primary side and the secondary side of the solenoid valve 120 is provided, and an opening/closing valve 160 is provided. The second channel 150 and the opening/closing valve 160 are the same as those described above with reference to the first embodiment.

Figure 10:
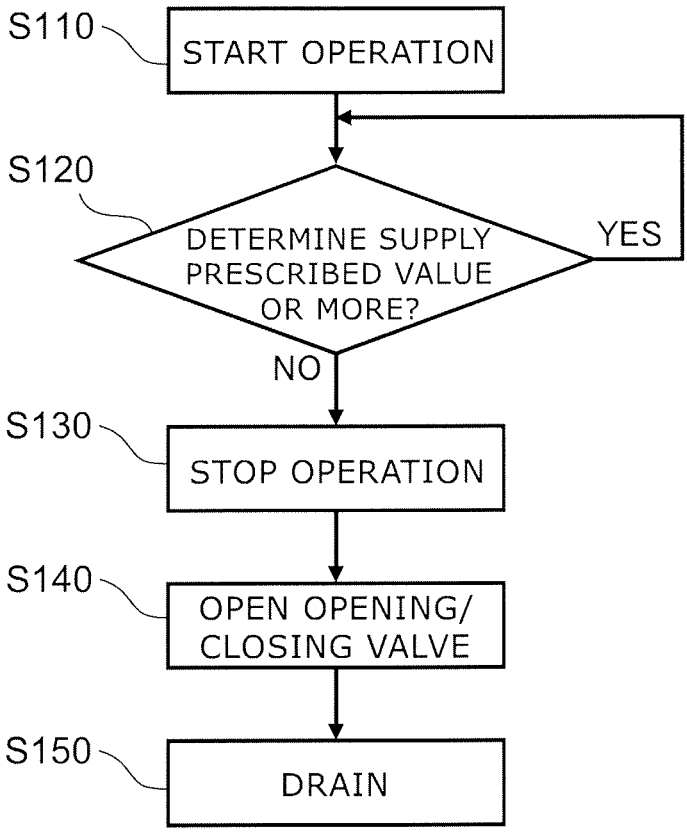
FIG. 10 is a flow chart showing the operation of the sanitary washing device 10 of the second embodiment.

FIG. 10 is a flow chart showing the operation of the sanitary washing device 10 of this embodiment.

When the sanitary washing device 10 is powered on to start operation (step S110), the supply detecting section 550 determines the state of water supply to the sanitary washing device 10 (step S120). For instance, in the case where the supply detecting section 550 is a water pressure sensor, it measures the primary pressure of the water supplied from the water supply source 20, or the secondary pressure reduced by the pressure regulator valve 130. Then, if the measured value is a prescribed value or more, the operation and measurement are continued (step S120: YES). On the other hand, if the amount of supply falls below the prescribed value (step S120: NO), the operation is stopped (step S130). That is, the operation of the heat exchange unit 200, the flow rate regulator valve unit 300, the nozzle unit 400 and the like is stopped to allow drainage on the primary side of the check valve 220 (see FIGS. 2 and 3).

Subsequently, the opening/closing valve 160 is opened (step S140), and drainage is performed through the second channel 150 (step S150). This operation is as described above with reference to the first embodiment.

According to this embodiment, the operation of the sanitary washing device 10 can be stopped before, or at the same time as, the opening/closing valve 160 is opened to perform drainage in response to the decrease of the supplied water pressure. Hence, the decrease of water supply can be detected by the supply detecting section 550 to stop the heater of the heat exchange unit 200 and the like before, for instance, drainage through the second channel 150 is started and a boil-dry protection sensor provided in the heat exchange unit 200 detects the decrease of water level.

Third Embodiment

Next, a third embodiment of the invention is described.

Figure 11:
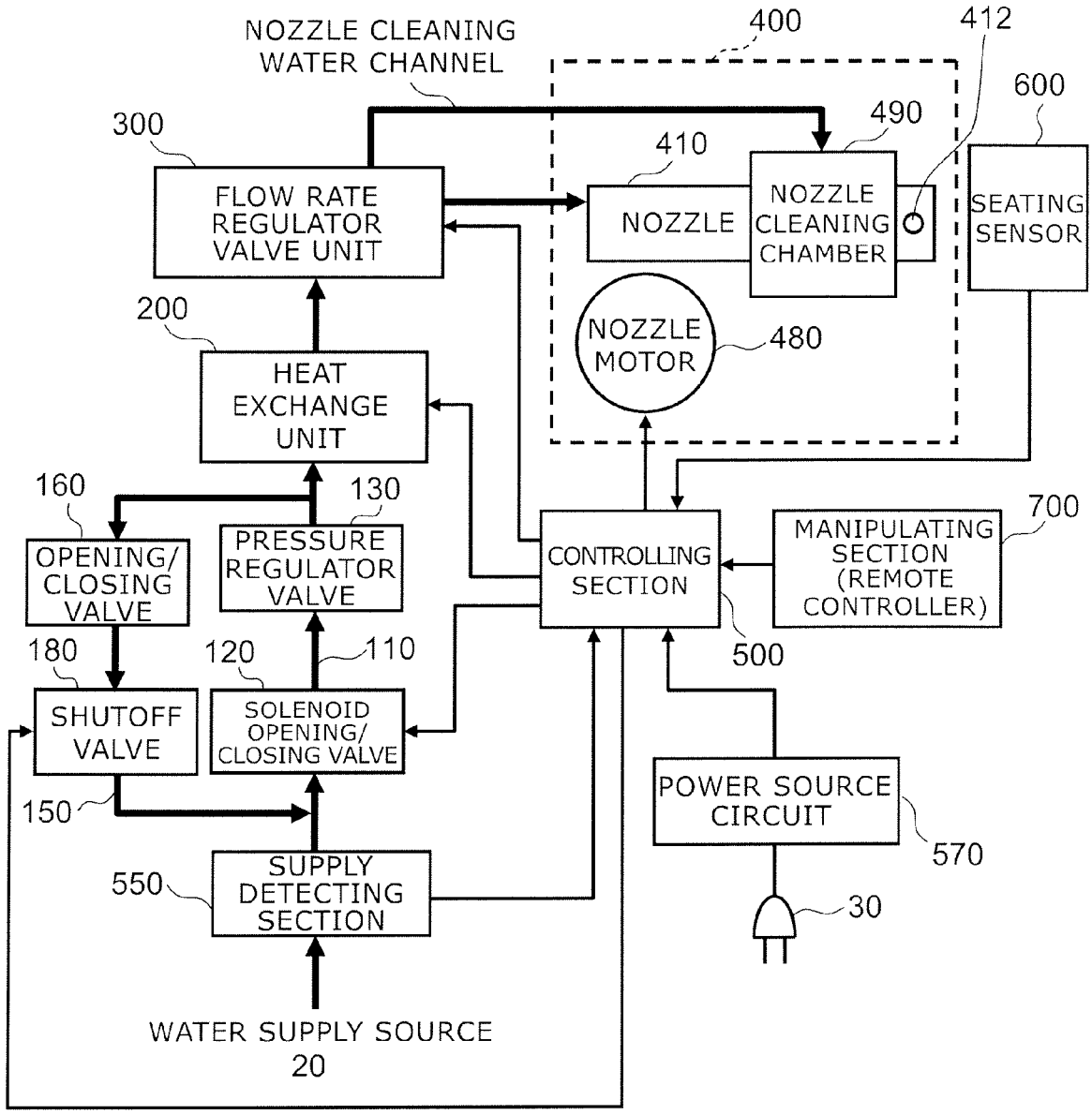
FIG. 11 is a block diagram of a sanitary washing device according to a third embodiment of the invention.

FIG. 11 is a block diagram of a sanitary washing device according to the third embodiment of the invention. Also in this figure, elements similar to those described above with reference to FIGS. 1 to 10 are labeled with like reference numerals, and the detailed description thereof is omitted.

Also in this embodiment, a supply detecting section 550 is provided like the second embodiment. Furthermore, also in this embodiment, a second channel 150 providing a bypass between the primary side and the secondary side of the solenoid valve 120 is provided, and an opening/closing valve 160 is provided. The second channel 150 and the opening/closing valve 160 are the same as those described above with reference to the first and second embodiment.

Furthermore, in this embodiment, a shutoff valve 180 is further provided in the second channel 150. The shutoff valve 180 is opened/closed by control from a controlling section 500 and serves to enable/disable drainage through the opening/closing valve 160. More specifically, the shutoff valve 180 is opened when drainage through the second channel 150 is allowed, and the shutoff valve 180 is closed when the drainage is not desired.

Figure 12:
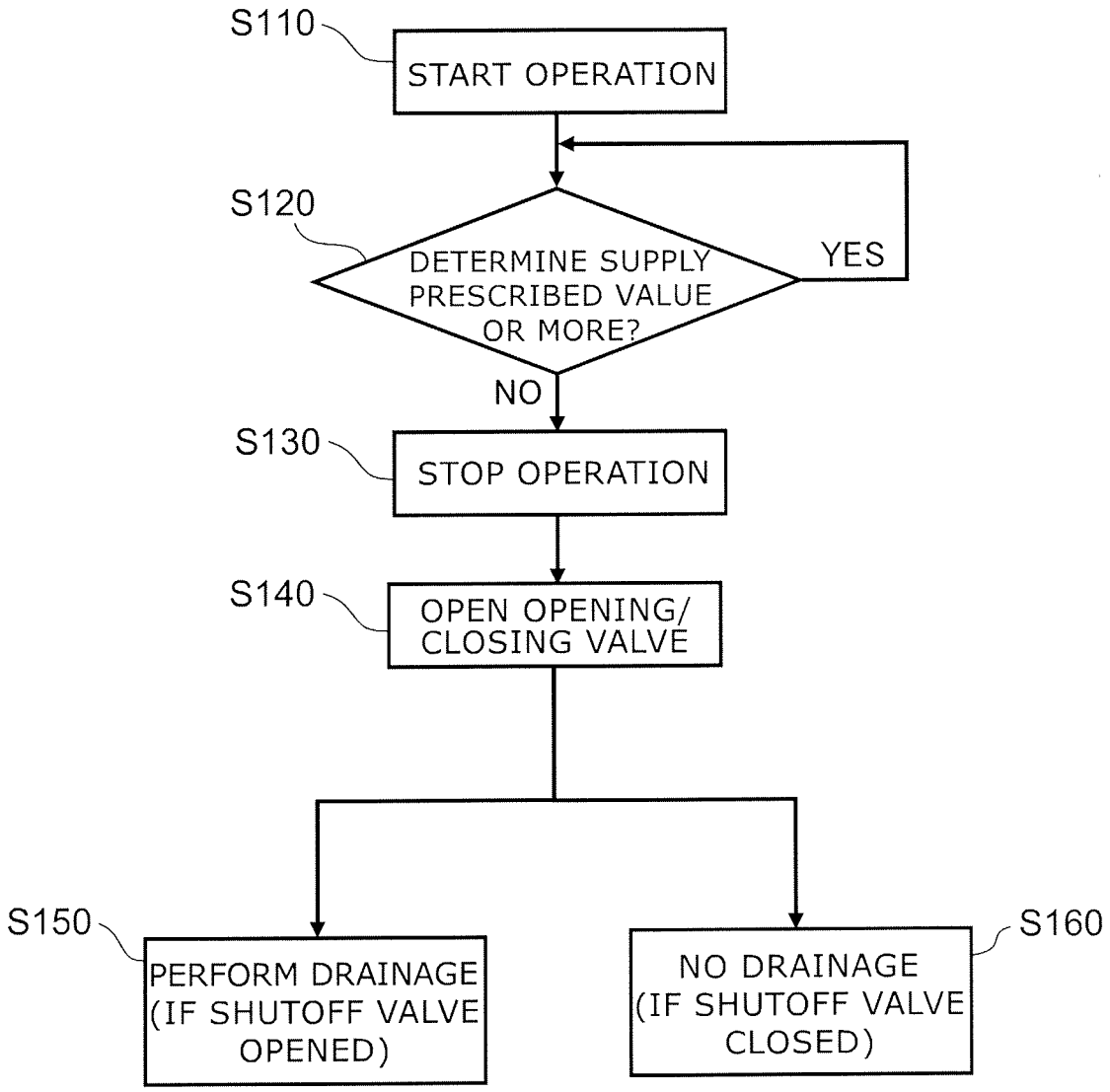
FIG. 12 is a flow chart showing the operation of the sanitary washing device 10 of the third embodiment.

FIG. 12 is a flow chart showing the operation of the sanitary washing device 10 of this embodiment.

The steps from starting operation (step S110) to opening the opening/closing valve 160 (step S14) are the same as those described above with reference to FIG. 9. However, user's switch manipulation or the like is performed as needed before reaching step S140 so that the shutoff valve 180 is either opened or closed.

In the case where the shutoff valve 180 is opened, drainage through the second channel 150 is performed when the opening/closing valve 160 is opened (step S150). On the other hand, in the case where the shutoff valve 180 is closed, drainage through the second channel 150 is not performed even if the opening/closing valve 160 is opened (step S160).

For instance, when the sanitary washing device 10 installed in a toilet is removed, it is often the case that the water stopcock of the toilet connected to the sanitary washing device 10 is closed to separate the water pipe to the sanitary washing device 10 from the water stopcock. When the water stopcock of the toilet is closed, the supplied water pressure decreases. Hence, the opening/closing valve 160 is opened, allowing drainage through the second channel 150 to start. However, at this time, because the water stopcock of the toilet is closed, water is not drained. This water will overflow from the water pipe to the sanitary washing device 10 when the water pipe is separated from the water stopcock. Hence, in such cases, the shutoff valve 180 can be closed to disable drainage and prevent water leakage from the water pipe.

If the shutoff valve 180 is opened after the water pipe is separated from the water stopcock and guided to a bucket or the like, no water is spilled on the floor of the toilet, and the water left inside the sanitary washing device 10 can be drained to the bucket or the like.

Furthermore, in this embodiment, if the shutoff valve 180 is a normally open opening/closing valve, water can be reliably drained through the second channel 150 at power-off. Hence, after power-off, containment of water inside the sanitary washing device 10 can be prevented. For instance, when the sanitary washing device 10 installed in the toilet is removed as described above, the water pipe is separated from the water stopcock and guided to a bucket or the like while power on, and then the power is shut down. Then, the normally open shutoff valve 180 is automatically opened, and the water left inside the sanitary washing device 10 can be drained to the bucket or the like.

Fourth Embodiment

Figure 13:
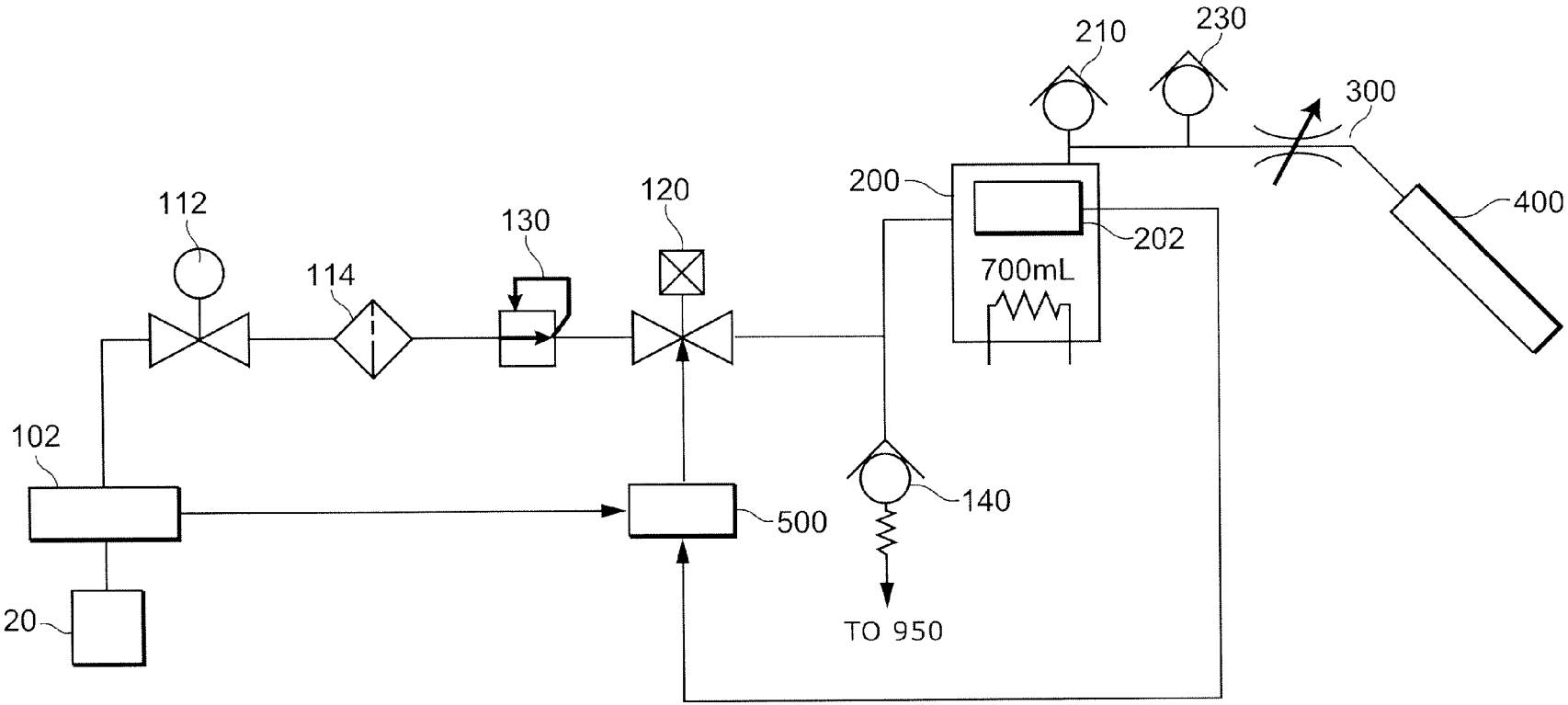
FIG. 13 is a block diagram showing the configuration of the water channel system of a sanitary washing device according to a fourth embodiment.

FIG. 13 is a block diagram showing the configuration of the water channel system of a sanitary washing device according to a fourth embodiment of the invention.

The sanitary washing device 10 includes a channel connected to a water supply source 20, such as waterworks and water storage tank, and led to a nozzle unit 400. On the upstream side of the channel is first provided a water pressure sensor 102. The water pressure sensor 102 can detect the pressure (water supply pressure) of water supplied from the water supply source 20. On the downstream side of the water pressure sensor 102 is provided a water stopcock 112. The water stopcock 112 is manually openable/closable, and can shut off the water channel (flow channel) whenever necessary on such occasions as installation/removal and maintenance/inspection of the sanitary washing device 10. Here, the water stopcock 112 may be provided in the sanitary washing device 10, or may be provided on the supply port side of the water supply source 20, such as waterworks, as an element separate from the sanitary washing device 10.

Downstream of the water stopcock 112, a strainer 114, a pressure regulator valve 130, and a solenoid opening/closing valve (channel opening/closing valve) 120 are provided. The strainer 114 is illustratively a filter with approximately 80 mesh and removes foreign matter mixed in the supplied water. The pressure regulator valve 130 serves to regulate the water supply pressure, if it is high, to within a prescribed pressure range. The solenoid opening/closing valve 120 is preferably a normally closed solenoid valve, that is, a solenoid valve which is closed when non-energized, and controls supply of water in accordance with commands from a controlling section 500.

A safety valve 140 is provided downstream of the solenoid opening/closing valve 120. The safety valve 140 is opened when the pressure of the water channel increases, and drains water to the bowl of the toilet bowl 950. The safety valve 140 thus provided can avoid water leakage inside the sanitary washing device 10 even if any failure of the pressure regulator valve 130, for instance, results in increasing the pressure of the water channel on its secondary side (downstream side).

A heat exchange unit 200 is provided downstream of the safety valve 140. The heat exchange unit 200 heats the supplied water with a heater to turn it into warm water at a prescribed temperature. A water level detecting device 202 is provided inside the heat exchange unit 200. The water level detecting device 202 can detect the level of water in the heat exchange unit 200. Downstream of the heat exchange unit 200, vacuum breakers 210, 230, a flow rate regulator valve unit (water stop valve) 300, and a nozzle unit 400 are connected. The vacuum breakers 210, 230 take in air from outside at the time of draining the water channel to facilitate draining the water channel between the heat exchange unit 200 and the nozzle unit 400. The flow rate regulator valve unit 300 regulates opening/closing and switching of water supply to the water discharge nozzle and nozzle cleaning chamber (see FIG. 17) provided in the nozzle unit 400, and adjustment of the force of water. A pulsator unit for pulsating water, for instance, may be provided on the secondary side of the flow rate regulator valve unit 300.

In this embodiment, the water pressure sensor 102 determines the presence or absence of water supply to the sanitary washing device 10 on the basis of water supply pressure. The determination result is transmitted from the water pressure sensor 102 to the controlling section 500. If the water pressure sensor 102 detects the state of no water supply, that is, the state of the water supply pressure being 0 (zero) or less, and transmits the detection result to the controlling section 500, then the controlling section 500 transmits a control signal for opening the solenoid opening/closing valve 120 to the solenoid opening/closing valve 120. When the solenoid opening/closing valve 120 is opened, the water left on the primary side (upstream side) of the heat exchange unit 200 can be drained toward the water supply source 20. For instance, in the case where the heat exchange unit 200 is provided with a hot water storage tank, approximately 700 milliliters of water may be left. According to this embodiment, such residual water can be reliably and readily drained through the channel. Here, the invention is not limited to those provided with a hot water storage tank, but also encompasses those provided with a heat exchanger of the so-called instantaneous heating type.

When the water pressure sensor 102 detects the state of the water supply pressure being "0" or less, the water left on the primary side of the heat exchange unit 200 is drained toward the water supply source 20. However, after the lapse of a prescribed time T1 (first prescribed time) after the water pressure sensor 102 detected the state of the water supply pressure being "0" or less, if the water level detecting device 202 detects water fill-up in the heat exchange unit 200, the controlling section 500 transmits a control signal for closing the solenoid opening/closing valve 120 to the solenoid opening/closing valve 120. Thus, even if water is supplied during drainage, or the water supply pressure temporarily becomes "0" or less, drainage can be reliably stopped, and water leakage from the nozzle unit 400 can be prevented.

The water left on the secondary side of the heat exchange unit 200 is drained as needed from the water discharge port of the nozzle unit 400, for instance, to the bowl of the toilet bowl 950. At this time, the vacuum breakers 210, 230 take in air, which facilitates drainage.

According to this embodiment, the water pressure sensor 102 determines the presence or absence of water supply to the sanitary washing device 10 on the basis of water supply pressure. When the water pressure sensor 102 detects the absence of water supply from the water supply source 20, the controlling section 500 automatically opens the solenoid opening/closing valve 120, and the water left in the water channel of the sanitary washing device 10 is drained toward the water supply source 20. That is, water drainage can be performed using the existing water supply pipe without need of user's drainage operation and without need of providing a special drainage mechanism.

For instance, in cold climates, when water supply to the sanitary washing device 10 is stopped, or when water is drained for the purpose of avoiding freezing of the water supply source 20, drainage of the sanitary washing device 10 can be automatically performed in response to the decrease of water supply pressure. That is, the user does not need to purposely manipulate the water stop valve and the drain valve of the sanitary washing device, but only needs to stop or drain the water supply source. Thus, this embodiment can provide a user-friendly sanitary washing device.

Furthermore, for instance, when a camper, train, airplane or the like with the sanitary washing device installed therein is parked in a low-temperature environment, the water supply source is often stopped. According to this embodiment, even in such cases, drainage of the sanitary washing device can be automatically performed in response to the decrease of the water pressure of the water supply source. Hence, also in these cases, the user does not need to purposely manipulate the water stop valve and the drain valve of the sanitary washing device, but only needs to stop or drain the water supply source. Thus, this embodiment can provide a user-friendly sanitary washing device.

Figure 14:
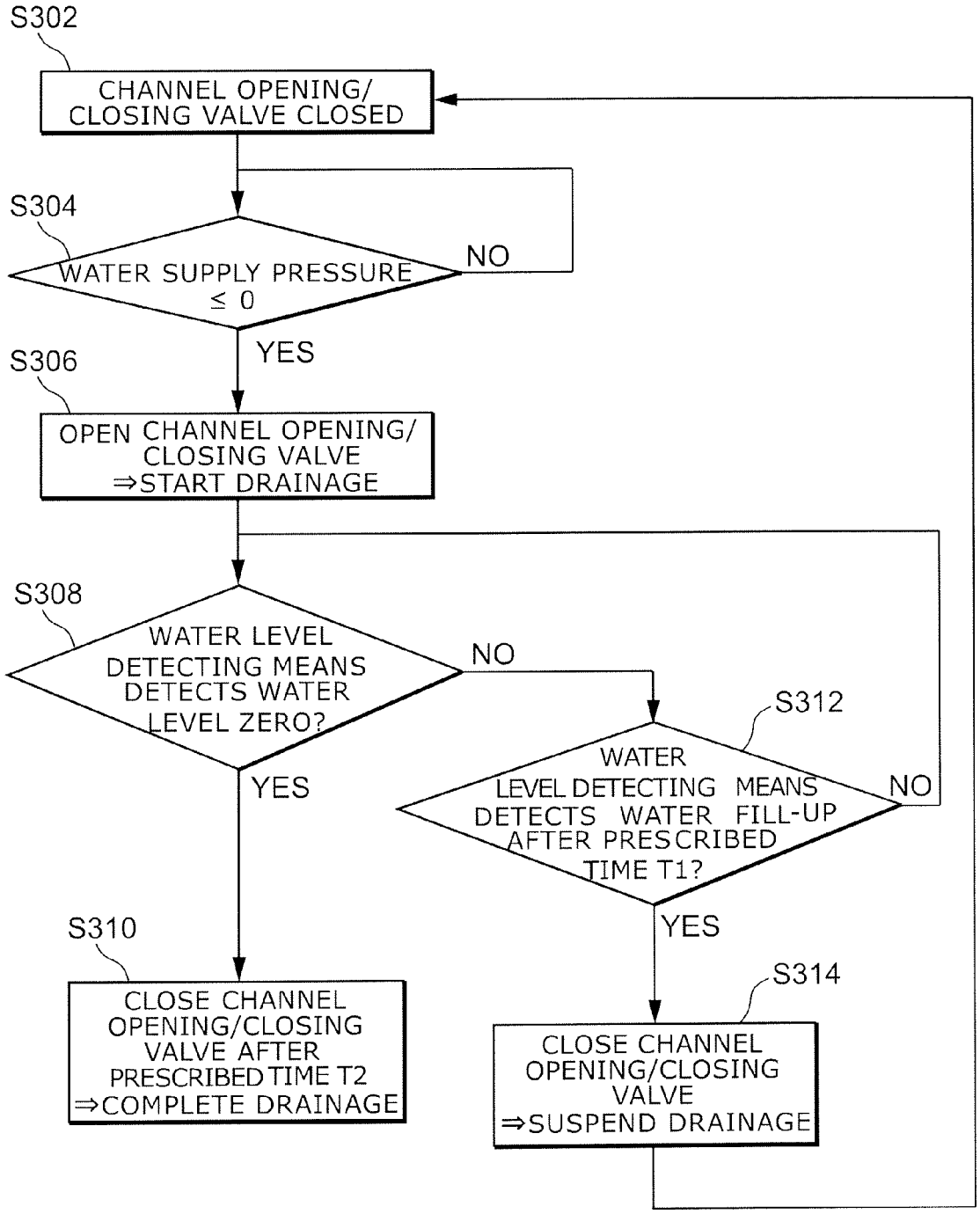
FIG. 14 is a flow chart showing the operation of the sanitary washing device according to the fourth embodiment.

FIG. 14 is a flow chart showing the operation of the sanitary washing device according to this embodiment.

When the sanitary washing device 10 is powered on and its operation is started, the solenoid opening/closing valve (channel opening/closing valve) 120 is closed (step S302). Subsequently, the water pressure sensor 102 determines whether the pressure (water supply pressure) of water supplied from the water supply source 20 is "0" or less (step S304). If the water supply pressure is "0" or less (step S304: YES), the controlling section 500 opens the solenoid opening/closing valve 120, and the water left in the water channel of the sanitary washing device 10 is drained toward the water supply source 20 (step S306). On the other hand, if the water supply pressure is not "0" or less (step S304: NO), the determination is continued as to whether the pressure of water supplied from the water supply source 20 is "0" or less (step S304).

Subsequently, the water level detecting device 202 provided in the heat exchange unit 200 determines whether the level of water in the heat exchange unit 200 is "0" (step S308). If the water level detecting device 202 detects that the level of water in the heat exchange unit 200 is "0" (step S308: YES), the solenoid opening/closing valve 120 is closed after the lapse of a prescribed time T2 (second prescribed time). Thus, by automatically closing the solenoid opening/closing valve 120 at the end of drainage, water leakage from the water discharge nozzle at the time of the next water supply can be prevented. That is, it is possible to prevent the solenoid opening/closing valve 120 from being left open at the time of the next water supply when the sanitary washing device 10 is not powered on.

On the other hand, if the water level detecting device 202 does not detect that the level of water in the heat exchange unit 200 is "0" (step S308: NO), the water level detecting device 202 determines whether the heat exchange unit 200 is filled with water (step S312) after the lapse of the prescribed time T1 (first prescribed time). If the heat exchange unit 200 is filled with water (step S312: YES), the controlling section 500 closes the solenoid opening/closing valve 120 (step S314). Hence, drainage of the sanitary washing device 10 is suspended (step S314). Thus, even if water is supplied during drainage, or the water supply pressure temporarily becomes "0" or less, water leakage from the water discharge nozzle can be prevented by detecting water fill-up in the heat exchange unit 200 and stopping drainage. On the other hand, if the heat exchange unit 200 is not filled with water (step S312: NO), the water level detecting device 202 determines again whether the level of water in the heat exchange unit 200 is "0" (step S308).

Figure 15:
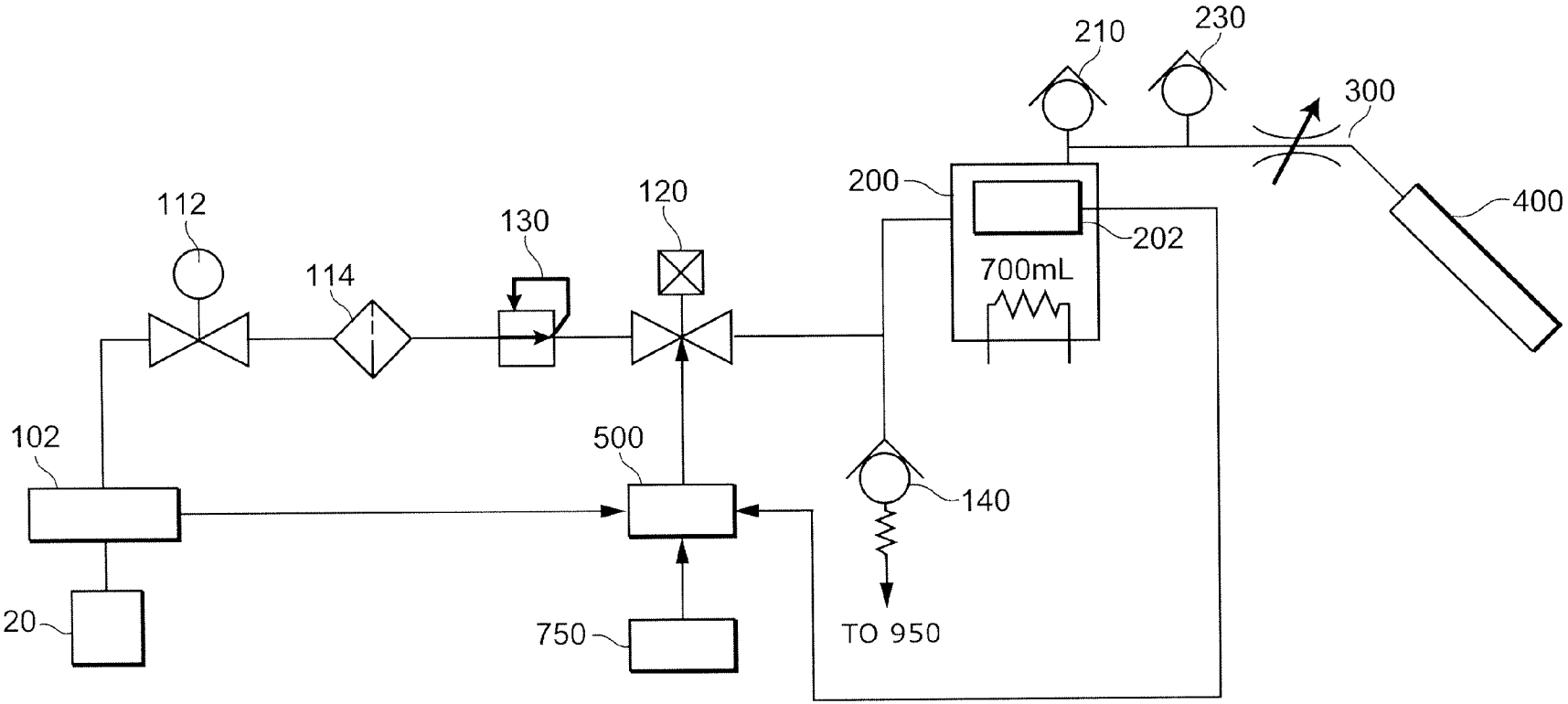
FIG. 15 is a block diagram showing the configuration of the water channel system of a sanitary washing device according to a variation of the fourth embodiment.

FIG. 15 is a block diagram showing the configuration of the water channel system of a sanitary washing device according to a variation of the fourth embodiment.

In this variation, if the water pressure sensor 102 detects that the water supply pressure from the water supply source 20 is "0" or less and a drainage operating section 750 transmits a signal for performing "drainage", then the controlling section 500 transmits a control signal for opening the solenoid opening/closing valve 120 to the solenoid opening/closing valve 120. The drainage operating section 750 is operated illustratively by a user. The drainage operating section 750 may be provided outside the sanitary washing device 10, or may be provided as part of the manipulating section (remote controller) 700 (see FIG. 17). Thus, the water pressure sensor 102 determines the presence or absence of water supply to the sanitary washing device 10 on the basis of water supply pressure, and only when the water pressure sensor 102 detects the state of no water supply from the water supply source 20, the controlling section 500 opens the solenoid opening/closing valve 120 for drainage so that the water left in the water channel of the sanitary washing device 10 is drained toward the water supply source 20. Hence, drainage can be reliably performed only in the state of no water supply. The rest of the structure is the same as that of the sanitary washing device 10 shown in FIG. 13.

Figure 16:
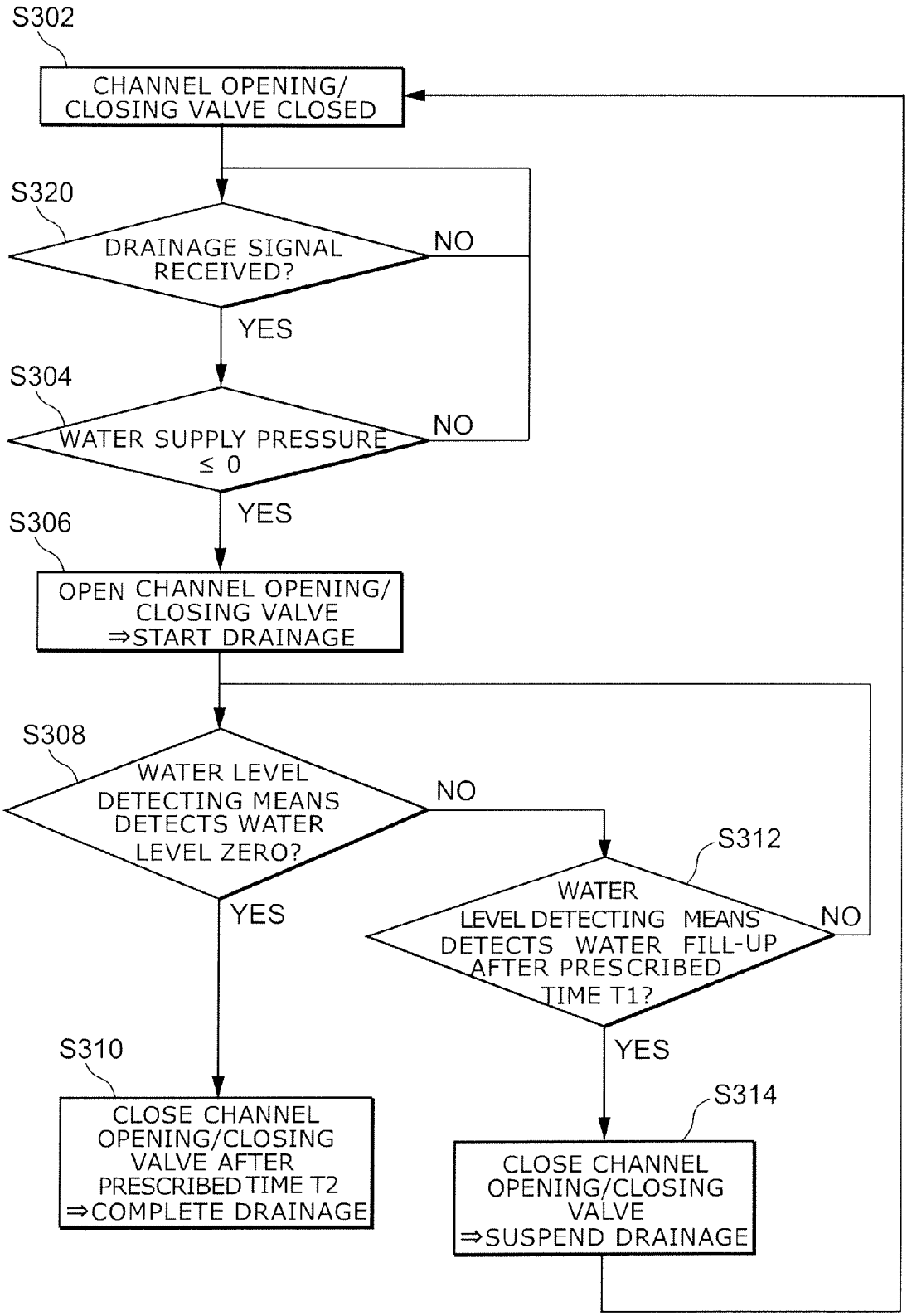
FIG. 16 is a flow chart showing the operation of the sanitary washing device according to the variation of the fourth embodiment.

FIG. 16 is a flow chart showing the operation of the sanitary washing device according to this variation.

First, when the sanitary washing device 10 is powered on and its operation is started, the solenoid opening/closing valve 120 is closed as in the flow chart shown in FIG. 14 (step S302). Subsequently, the controlling section 500 determines whether a "drainage" signal is received. If the controlling section 500 has received the "drainage" signal from the drainage operating section 750 (step S320: YES), the water pressure sensor 102 determines whether the pressure (water supply pressure) of water supplied from the water supply source 20 is "0" or less (step S304). On the other hand, if the controlling section 500 has not received the "drainage" signal from the drainage operating section 750 (step S320: NO), the controlling section 500 continues to determine whether the "drainage" signal is received (step S320). The operation of step S304 and later is the same as that of the flow chart shown in FIG. 14.

According to this variation, drainage of water left in the water channel of the sanitary washing device 10 is not performed simply by the user's operation of the drainage operating section 750 to transmit a "drainage" signal. Drainage of water left in the water channel of the sanitary washing device 10 is performed only after the controlling section 500 receives the "drainage" signal and the signal of the water supply pressure being "0" or less. That is, drainage can be reliably performed only in the state of no water supply.

Figure 17:
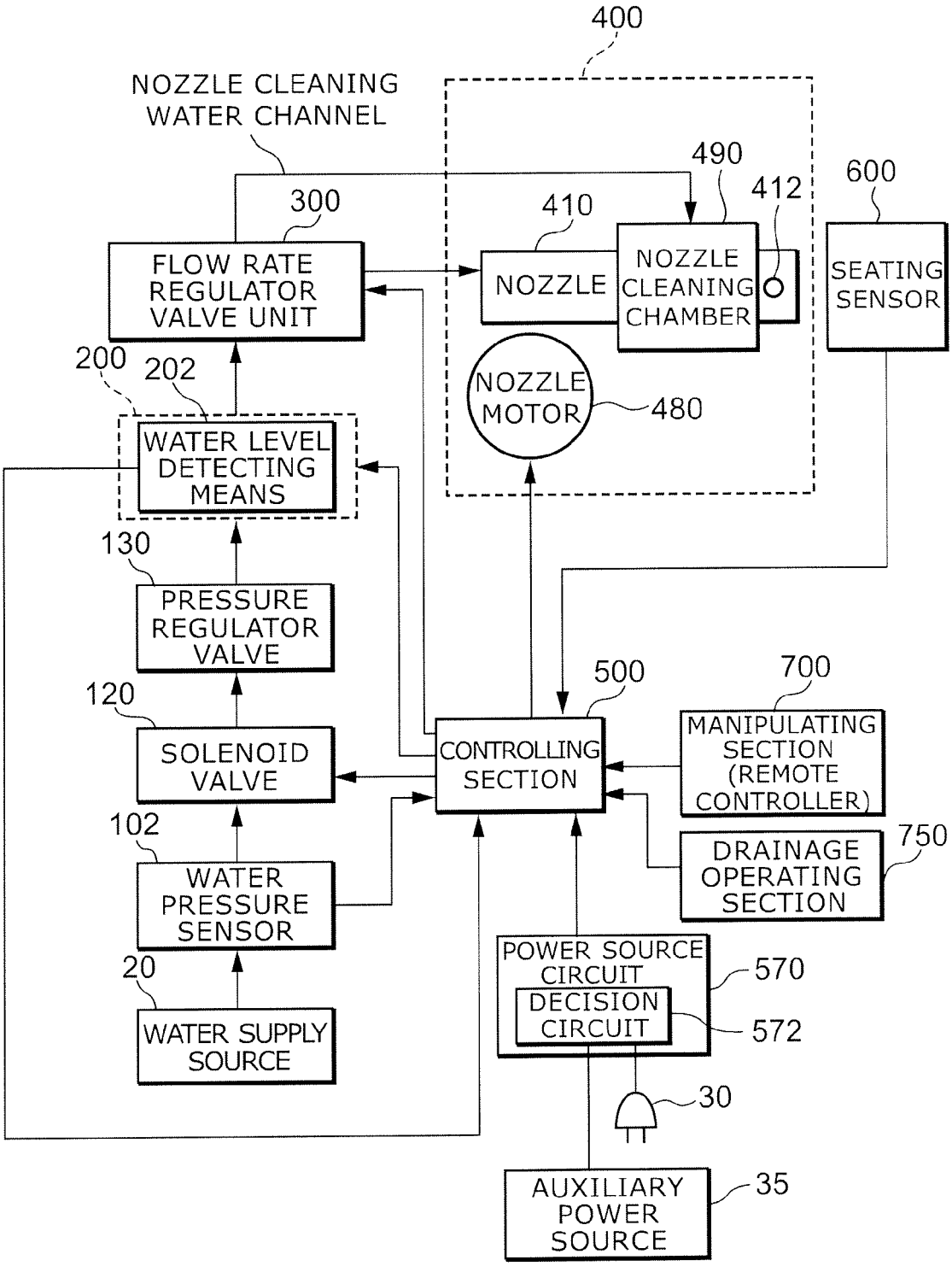
FIG. 17 is a block diagram of the sanitary washing device according to the fourth embodiment.

FIG. 17 is a block diagram of the sanitary washing device according to the fourth embodiment.

The block diagram shown in FIG. 17 can encompass the sanitary washing device shown in FIG. 13 and the sanitary washing device shown in FIG. 15.

As described above with reference to FIGS. 13 and 15, a water pressure sensor 102, a solenoid opening/closing valve 120, a pressure regulator valve 130, a heat exchange unit 200, vacuum breakers 210, 230, and a flow rate regulator valve unit 300 are provided in the channel connected to a water supply source 20 and led to a nozzle unit 400. A water level detecting device 202 for detecting water level in the heat exchange unit 200 can be provided as needed inside the heat exchange unit 200. The water level detecting device 202 transmits information on the water level in the heat exchange unit 200 to a controlling section 500.

The nozzle unit 400 includes a water discharge nozzle 410, a nozzle motor 480 for extending/retracting it, and a nozzle cleaning chamber 490 for squirting water to the outer periphery of the water discharge nozzle 410 to clean its body. The operation of these elements is controlled by the controlling section 500. The controlling section 500 receives as input, for instance, a signal from a seating sensor 600 for detecting that a user is seated on the toilet seat 14, information of switch manipulation by a manipulating section (remote controller) 700 and the like, and a signal from a drainage operating section 750 for performing "drainage". However, as described above with reference to FIG. 15, the drainage operating section 750 may be provided as part of the manipulating section 700.

This embodiment prevents water from flowing out of the water discharge port 412 of the water discharge nozzle 410 when the water discharge nozzle 410 is not in use.

For instance, from any cause, the solenoid valve (solenoid opening/closing valve) 120 may fail to be completely closed. If the solenoid valve 120 is not completely closed, water is supplied to the heat exchange unit 200, the flow rate regulator valve unit 300 and the like. In such cases, if the flow rate regulator valve unit 300 is opened, water may flow out of the water discharge port 412 of the water discharge nozzle 410, for instance. That is, when the sanitary washing device 10 is not powered on, or when water discharge from the water discharge nozzle 410 is not performed, water may be drained from the water discharge port 412 of the water discharge nozzle 410.

Thus, in this embodiment, the channel on the primary side of the water discharge nozzle 410 and the nozzle cleaning chamber 490 is shut off when water discharge from the water discharge nozzle 410 and nozzle cleaning in the nozzle cleaning chamber 490, for instance, are not performed. Specifically, for instance, a shutoff valve can be provided either before or after the flow rate regulator valve unit 300 so that the controlling section 500 can close this shutoff valve when water discharge from the water discharge nozzle 410 and nozzle cleaning in the nozzle cleaning chamber 490, for instance, are not performed. Alternatively, the channel can be closed in the flow rate regulator valve unit 300 when water discharge from the water discharge nozzle 410 and nozzle cleaning in the nozzle cleaning chamber 490, for instance, are not performed.

Furthermore, this embodiment may include an auxiliary power source 35 and a decision circuit 572. The decision circuit 572 is provided illustratively inside a power source circuit 570. If power is supplied from the power source 30, the decision circuit 572 preferentially uses power supply from the power source 30 for the operation of the sanitary washing device 10. On the other hand, if the decision circuit 572 detects that power supply from the power source 30 is stopped from any cause, it switches to power supply from the auxiliary power source 35, and the power supply is used for the operation of the sanitary washing device 10.

Thus, even if the sanitary washing device 10 is powered off during the "drainage" operation, for instance, the operation of the water pressure sensor 102 and the solenoid opening/closing valve 120 can be continued, which allows the water left in the channel to be reliably drained. In contrast, in the case where the auxiliary power source 35 and the decision circuit 572 are not provided, if the sanitary washing device 10 is powered off, the operation of the water pressure sensor 102 is stopped, which makes it impossible to detect the water supply pressure. Hence, the "drainage" operation is stopped, and the water left in the channel may fail to be reliably drained.

As described above, according to this embodiment, the water pressure sensor 102 determines the presence or absence of water supply to the sanitary washing device 10 on the basis of water supply pressure. When the water pressure sensor 102 detects the absence of water supply from the water supply source 20, the controlling section 500 automatically opens the solenoid opening/closing valve 120, and the water left in the water channel of the sanitary washing device 10 is drained toward the water supply source 20. Alternatively, the water left in the water channel of the sanitary washing device 10 is drained toward the water supply source 20 only after the controlling section 500 receives the "drainage" signal and the signal of the water supply pressure being "0" or less.

Fifth Embodiment

Figure 18:
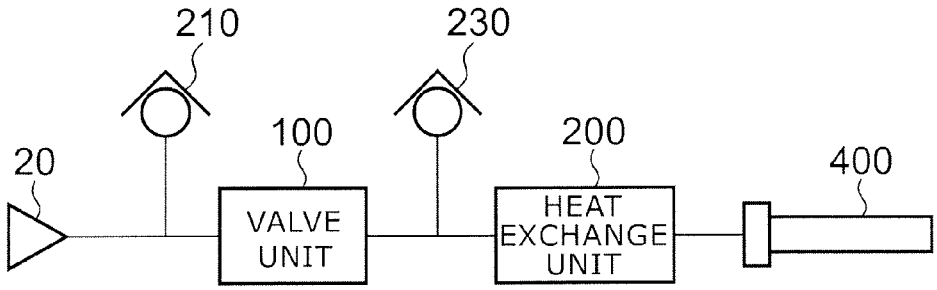
FIG. 18 is a block diagram showing the configuration of the water channel system of a sanitary washing device according to a fifth embodiment.

FIG. 18 is a block diagram showing the configuration of the water channel system of a sanitary washing device according to a fifth embodiment of the invention.

The sanitary washing device 10 includes a channel connected to a water supply source 20, such as waterworks and water storage tank, and led to a nozzle unit 400. On the upstream side of the channel is first provided a pressure releasing device 210, such as a vacuum breaker. In the following, a description is given assuming that the pressure releasing device is a vacuum breaker. The vacuum breaker 210 (first pressure releasing device) takes in air from outside at the time of draining the water channel (flow channel) to facilitate draining the water channel. A valve unit 100 is provided on the downstream side of the vacuum breaker 210. As described below with reference to FIGS. 18 and 19, the valve unit 100 illustratively includes a solenoid opening/closing valve (channel opening/closing valve) 120 serving as a water stop valve, and a pressure regulator valve 130.

A vacuum breaker 230 (second pressure releasing device) is provided on the downstream side of the valve unit 100. Like the vacuum breaker 210, the vacuum breaker 230 takes in air from outside at the time of draining the water channel (flow channel) to facilitate draining the water channel. A heat exchange unit 200 is provided on the downstream side of the vacuum breaker 230. The heat exchange unit 200 is a heat exchanger of the so-called instantaneous heating type, which instantaneously heats the water passed through the channel. The heat exchange unit 200 heats the supplied water with a heater to turn it into warm water at a prescribed temperature. Here, the term "instantaneous" refers to the instantaneous heating type, as opposed to the hot water storage heating type described later. A nozzle unit 400 is provided on the downstream side of the heat exchange unit 200. The nozzle unit 400 includes a flow rate regulator valve unit (see FIG. 22) which regulates opening/closing and switching of water supply to the water discharge nozzle and nozzle cleaning chamber (see FIG. 22), and adjustment of the force of water.

In this embodiment, each time water supply is stopped, the water left between the valve unit 100 and the nozzle unit 400 is drained from the water discharge port 412 (see FIG. 22) of the nozzle unit 400 to the bowl of the toilet bowl 950. At this time, the vacuum breaker 230 takes in air, which facilitates drainage. The heat exchange unit 200 is a heat exchanger of the so-called instantaneous heating type, and hence the water left between the valve unit 100 and the nozzle unit 400 can be drained. This is because water can be turned into warm water without storing water in the heat exchanger.

In contrast, if the heat exchange unit 200 is a heat exchanger of the so-called hot water storage heating type, which is provided with a hot water storage tank, water needs to be stored in the hot water storage tank. Hence, it is practically impossible to drain all the water left between the valve unit 100 and the nozzle unit 400. This is because, if all the water left between the valve unit 100 and the nozzle unit 400 is drained, the water in the hot water storage tank is emptied, which makes it impossible to turn water into warm water.

Furthermore, when the water pressure from the water supply source 20 becomes zero or negative, the water left between the water supply source 20 and the valve unit 100 is drained toward the water supply source 20. At this time, the vacuum breaker 210 takes in air, which facilitates drainage. Thus, the sanitary washing device 10 according to this embodiment can drain the sanitary washing device 10 in accordance with the presence or absence of water supply from outside.

Furthermore, even after the power supply to the sanitary washing device 10 is stopped, drainage can be reliably performed. That is, irrespective of the presence or absence of power supply to the sanitary washing device 10, drainage can be performed in accordance with the presence or absence of water supply. Water drainage can be performed using the existing water supply pipe without need of user's drainage operation and without need of providing a special drainage mechanism.

For instance, in cold climates, when water supply to the sanitary washing device 10 is stopped, or when water is drained for the purpose of avoiding freezing of the water supply source 20, drainage of the sanitary washing device 10 can be automatically performed in accordance with the presence or absence of water supply from outside. That is, the user does not need to purposely manipulate the drain valve and the like of the sanitary washing device, but only needs to stop or drain the water supply source. Thus, this embodiment can provide a user-friendly sanitary washing device.

Furthermore, for instance, when a camper, train, airplane or the like with the sanitary washing device installed therein is parked in a low-temperature environment, the water supply source is stopped, and the power supply is often stopped as well. According to this embodiment, even in such cases, drainage of the sanitary washing device can be automatically performed in accordance with the presence or absence of water supply from outside. Hence, also in these cases, the user does not need to purposely manipulate the drain valve and the like of the sanitary washing device, but only needs to stop or drain the water supply source. Thus, this embodiment can provide a user-friendly sanitary washing device.

In the following, examples of the fifth embodiment are described with reference to the drawings.

Figure 19:
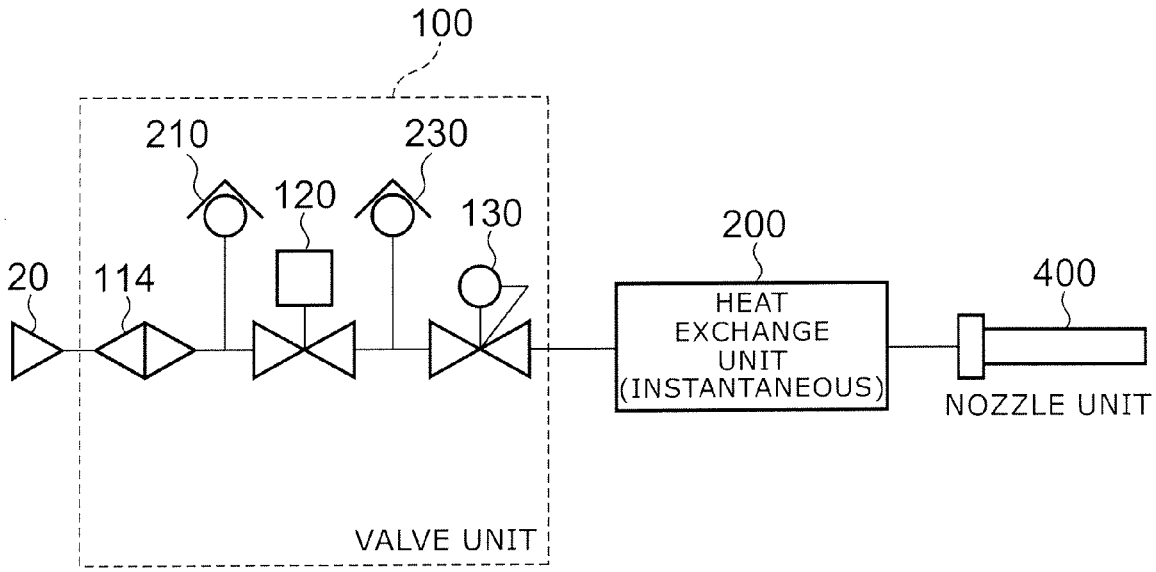
FIG. 19 is a block diagram showing the configuration of the water channel system of a sanitary washing device according to an example of the fifth embodiment.

FIG. 19 is a block diagram showing the configuration of the water channel system of a sanitary washing device according to an example of the fifth embodiment.

In this example, the vacuum breaker 210 and the vacuum breaker 230 are provided inside the valve unit 100. A strainer 114 is provided on the upstream side of the vacuum breaker 210. The strainer 114 is illustratively a filter with approximately 80 mesh and removes foreign matter mixed in the supplied water. A solenoid opening/closing valve (channel opening/closing valve) 120 is provided on the downstream side of the vacuum breaker 210 and on the upstream side of the vacuum breaker 230. That is, the vacuum breaker 210, the vacuum breaker 230, and the solenoid opening/closing valve 120 are integrated in structure. The solenoid opening/closing valve 120 is illustratively a normally closed solenoid valve, that is, a solenoid valve which is closed when non-energized, and controls supply of water in accordance with commands from the controlling section (see FIG. 22). A pressure regulator valve 130 is provided on the downstream side of the vacuum breaker 230. The pressure regulator valve 130 serves to regulate the water supply pressure, if it is high, to within a prescribed pressure range. The rest of the structure is the same as that of the water channel system of the sanitary washing device 10 described with reference to FIG. 18.

In this example, the solenoid opening/closing valve 120 is preferably located at the highest position (uppermost point). Alternatively, the water discharge port 412 of the nozzle unit 400 is preferably located at the lowest position (lowermost point). This allows the water left in the water channel to be drained more reliably. Alternatively, the water discharge port 412 of the nozzle unit 400 only needs to be located lower than the solenoid opening/closing valve 120. This allows the water left in the water channel to be drained more reliably by the siphon effect. Furthermore, because the vacuum breaker 210, the vacuum breaker 230, and the solenoid opening/closing valve 120 are integrated in structure, less water is left therein, which allows more reliable drainage.

When the user washes the "bottom" and the like and finishes the washing, the solenoid opening/closing valve 120 is closed, and water supply from the water supply source 20 is stopped. When water supply from the water supply source 20 is stopped, the water left on the secondary side (downstream side) of the solenoid opening/closing valve 120 is drained from the water discharge port 412 of the nozzle unit 400 to the bowl of the toilet bowl 950. On the other hand, when the water pressure from the water supply source 20 becomes zero or negative, the water left on the primary side (upstream side) of the solenoid opening/closing valve 120 is drained toward the water supply source 20.

Figure 20:
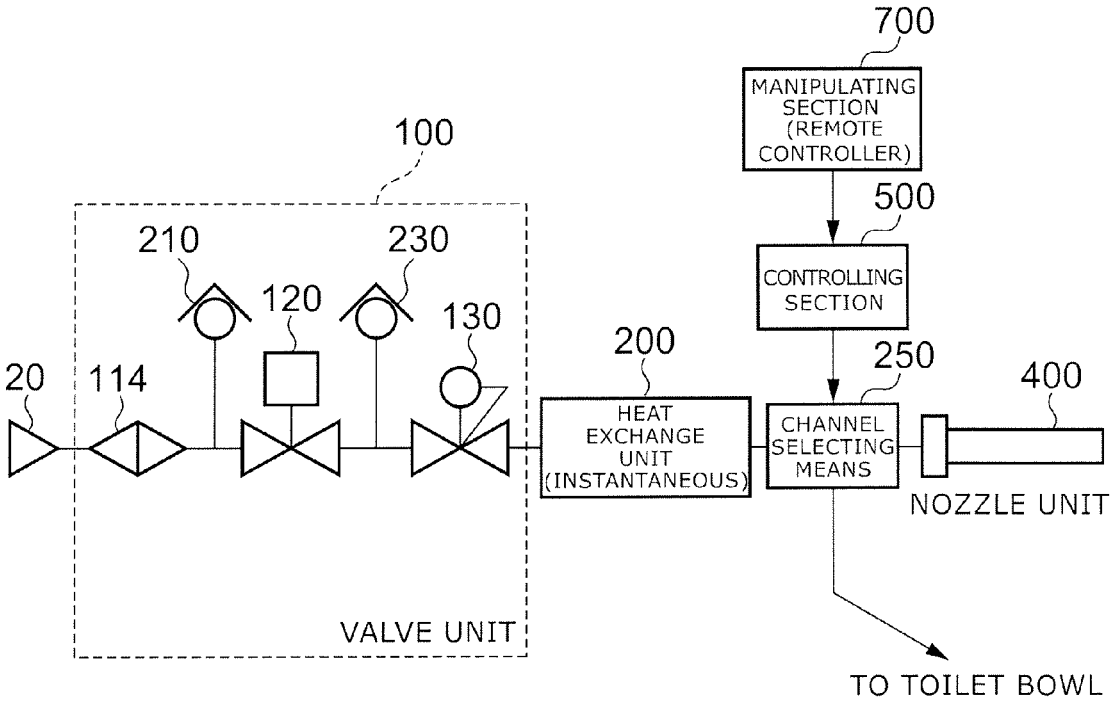
FIG. 20 is a block diagram showing the configuration of the water channel system of a sanitary washing device according to another example of the fifth embodiment.

FIG. 20 is a block diagram showing the configuration of the water channel system of a sanitary washing device according to another example of the fifth embodiment.

In the sanitary washing device 10 according to this example, a channel selecting device 250 is provided on the downstream side of the heat exchange unit 200 and on the upstream side of the nozzle unit 400. The channel selecting device 250 serves to switch the water from the water supply source 20 to one of the channel guided to the nozzle unit 400, and the channel guided to both of the channel guided to the nozzle unit 400 and the channel directly guided to the bowl of the toilet bowl 950. The rest of the structure is the same as that of the sanitary washing device 10 described with reference to FIG. 19.

The operation of the channel selecting device 250 is controlled by a controlling section 500. For instance, if an instruction for washing is issued from the user through the manipulating section 700, the controlling section 500 receives the instruction and controls the channel selecting device 250 to switch the water from the water supply source 20 to the channel guided to the nozzle unit 400. On the other hand, when the solenoid opening/closing valve 120 is closed to complete washing, the controlling section 500 controls the channel selecting device 250 to pass water to both the channel guided to the nozzle unit 400 and the channel directly guided to the bowl of the toilet bowl 950 without the intermediary of the nozzle unit 400.

That is, only during washing, the channel selecting device 250 switches the water from the water supply source 20 exclusively to the channel guided to the nozzle unit 400. Thus, water is drained from the two channels, and hence drainage can be rapidly performed. Also in this example, the solenoid opening/closing valve 120 is preferably located at the highest position. Alternatively, the water discharge port 412 of the nozzle unit 400 is preferably located at the lowest position. Alternatively, the water discharge port 412 of the nozzle unit 400 only needs to be located lower than the solenoid opening/closing valve 120.

The channel selecting device can be implemented by opening/closing valves each provided in the channel guided to the nozzle unit 400 and the channel directly guided to the bowl of the toilet bowl 950 without the intermediary of the nozzle unit 400, or by a three-way valve provided at the branching portion of the channel guided to the nozzle unit 400 and the channel directly guided to the bowl of the toilet bowl 950 without the intermediary of the nozzle unit 400.

Figure 21:
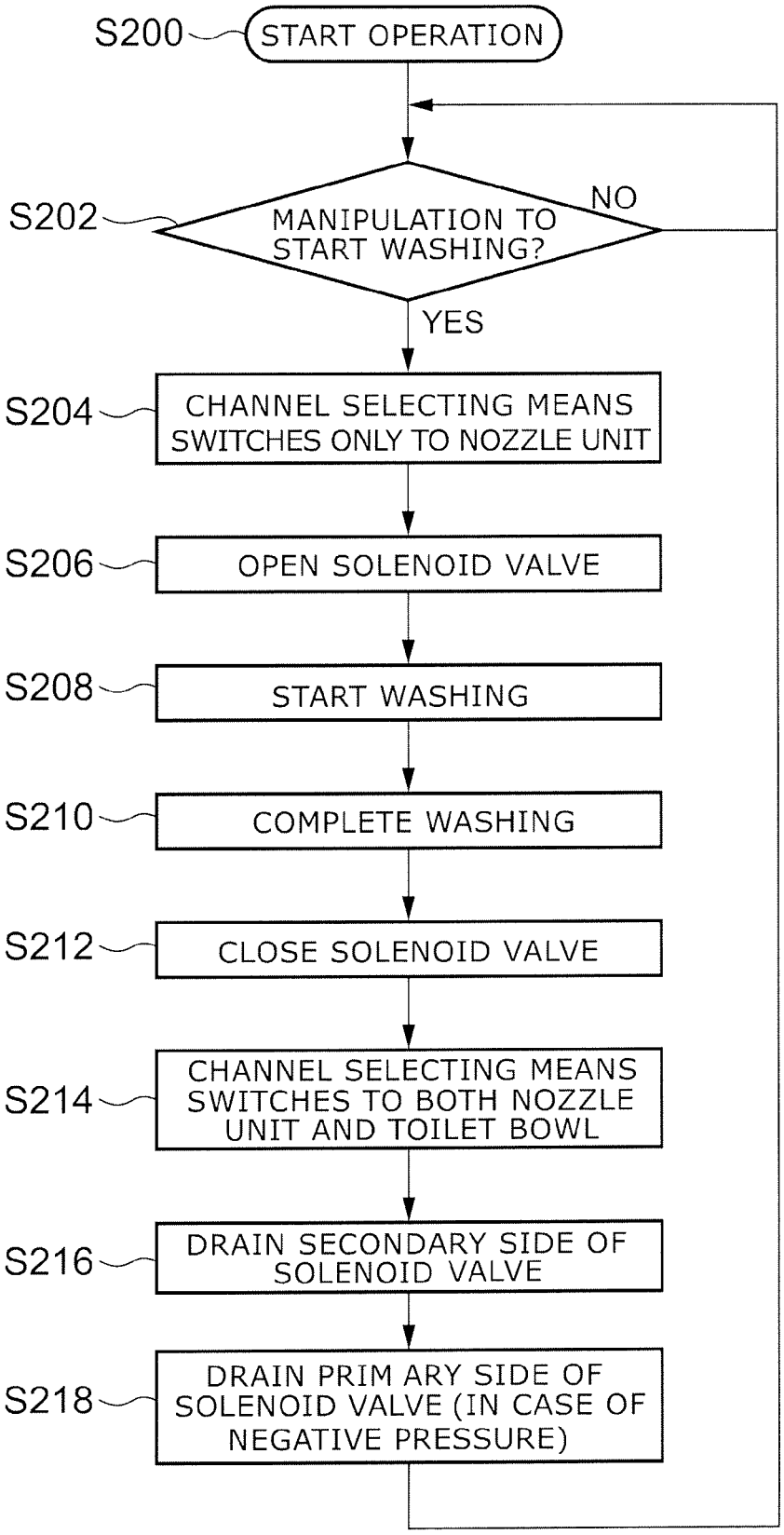
FIG. 21 is a flow chart showing the operation of the sanitary washing device according to the example of the fifth embodiment.

FIG. 21 is a flow chart showing the operation of the sanitary washing device according to this example.

When the sanitary washing device 10 is powered on to start operation (step S200), the controlling section 500 determines whether an instruction for starting washing the "bottom" and the like is issued by user's manipulation of the manipulating section 700 (step S202). If no instruction for starting washing is issued (step S202: NO), the determination is continued (step S202). On the other hand, if an instruction for starting washing the "bottom" and the like is issued from the manipulating section 700, the controlling section 500 controls the channel selecting device 250 to switch the water from the water supply source 20 to the channel guided to the nozzle unit 400 (step S204).

Subsequently, the controlling section 500 opens the solenoid opening/closing valve 120 to allow the water from the water supply source 20 to flow to the nozzle unit 400 (step S206). Subsequently, washing of user's "bottom" and the like is started (step S208), and then completed (step S210). Subsequently, the controlling section 500 closes the solenoid opening/closing valve 120 (step S212) to block the water from the water supply source 20 from flowing through the channel. Subsequently, the controlling section 500 controls the channel selecting device 250 to pass water to both the channel guided to the nozzle unit 400 and the channel directly guided to the bowl of the toilet bowl 950.

Subsequently, the vacuum breaker 230 takes in air, and the water left on the secondary side of the solenoid opening/closing valve 120 is drained directly to the bowl of the toilet bowl 950 through the nozzle unit 400 (step S216). Subsequently, when the water pressure from the water supply source 20 becomes zero or negative, the vacuum breaker 210 takes in air, and the water left on the primary side (upstream side) of the solenoid opening/closing valve 120 is automatically drained toward the water supply source 20.

According to this example, because the vacuum breaker 210, the vacuum breaker 230, and the solenoid opening/closing valve 120 are integrated in structure, less water is left therein, which allows more reliable drainage. Furthermore, when drainage is performed, the channel selecting device 250 switches to the channel directly guided to the bowl of the toilet bowl 950, preventing water from being drained from the water discharge port 412 of the nozzle unit 400. Hence, water leakage inside the sanitary washing device 10 can be prevented more reliably.

Figure 22:
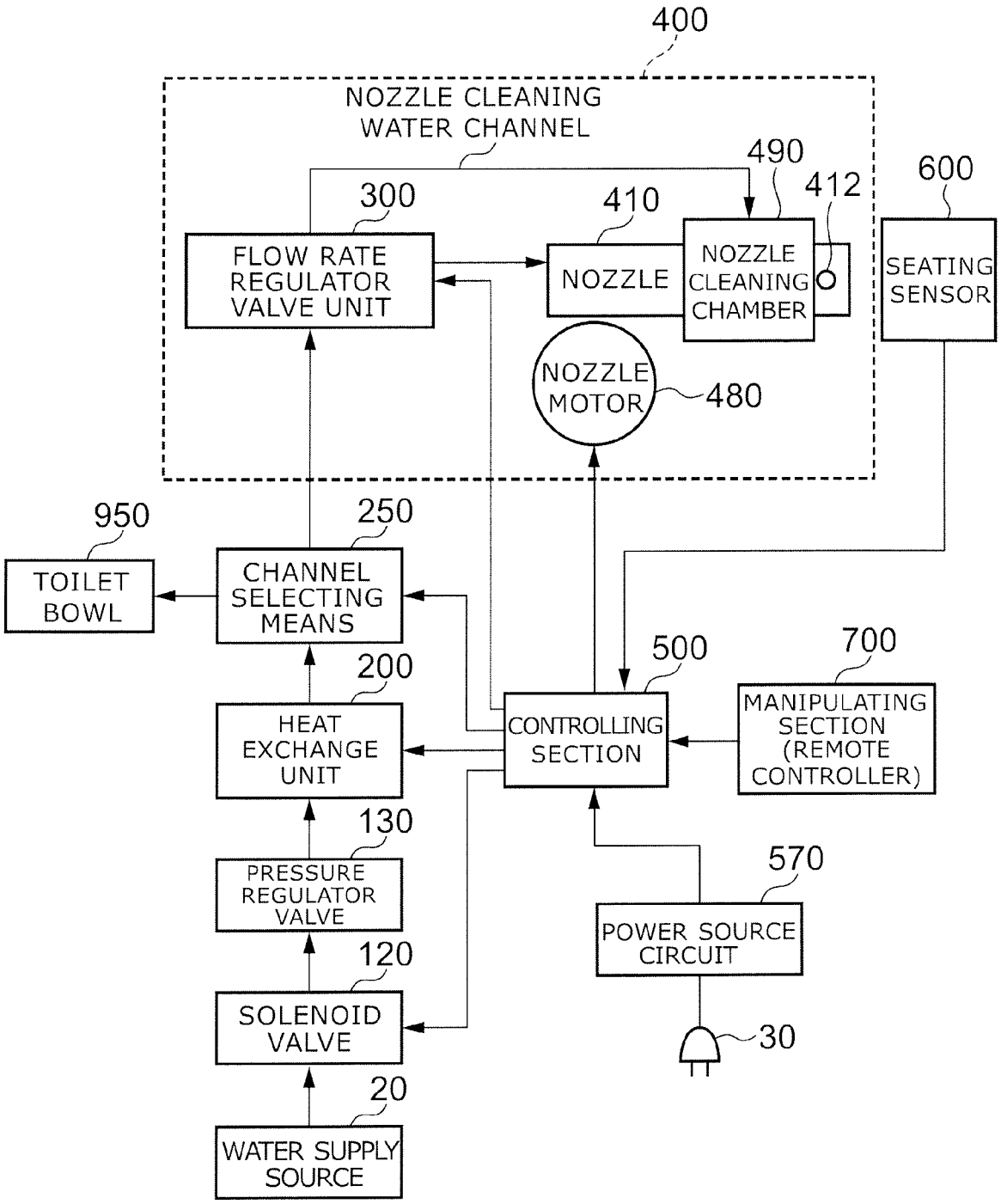
FIG. 22 is a block diagram of the sanitary washing device according to the fifth embodiment.

FIG. 22 is a block diagram of the sanitary washing device according to the fifth embodiment.

As described above with reference to FIGS. 19 and 20, a vacuum breaker 210, a solenoid opening/closing valve (solenoid valve) 120, a vacuum breaker 230, a pressure regulator valve 130, and a heat exchange unit 200 are provided in the channel connected to a water supply source 20 and led to a nozzle unit 400. The strainer 114, the channel selecting device 250 and the like described above with reference to FIGS. 19 and 20 can also be provided as needed.

The nozzle unit 400 includes a water discharge nozzle 410, a nozzle motor 480 for extending/retracting it, and a nozzle cleaning chamber 490 for squirting water to the outer periphery of the water discharge nozzle 410 to clean its body. The operation of these elements is controlled by a controlling section 500. The controlling section 500 receives as input a signal from a seating sensor 600 for detecting that a user is seated on the toilet seat 14, and information of switch manipulation by a remote controller and the like.

This embodiment prevents water from flowing out of the water discharge port 412 of the water discharge nozzle 410 when the water discharge nozzle 410 is not in use.

For instance, from any cause, the solenoid valve 120 may fail to be completely closed. If the solenoid valve 120 is not completely closed, water is supplied to the heat exchange unit 200, the flow rate regulator valve unit 300 and the like. In such cases, if the flow rate regulator valve unit 300 is opened, water may flow out of the water discharge port 412 of the water discharge nozzle 410, for instance. That is, when the sanitary washing device 10 is not powered on, or when water discharge from the water discharge nozzle 410 is not performed, water may be drained from the water discharge port 412 of the water discharge nozzle 410.

Thus, in this embodiment, the channel on the primary side of the water discharge nozzle 410 and the nozzle cleaning chamber 490 is shut off after water discharge from the water discharge nozzle 410 and nozzle cleaning in the nozzle cleaning chamber 490, for instance, are performed and drainage is completed. Specifically, for instance, a shutoff valve can be provided either before or after the flow rate regulator valve unit 300 so that the controlling section 500 can close this shutoff valve in expectation of the time to complete drainage after water discharge from the water discharge nozzle 410 and nozzle cleaning in the nozzle cleaning chamber 490, for instance, are performed. Alternatively, the channel can be closed in the flow rate regulator valve unit 300 when water discharge from the water discharge nozzle 410 and nozzle cleaning in the nozzle cleaning chamber 490, for instance, are not performed.

Furthermore, as described above with reference to FIG. 20, a channel selecting device 250 may be provided between the heat exchange unit 200 and the flow rate regulator valve unit 300. Then, at times other than during washing, the channel selecting device 250 is switched to the channel which guides the water from the water supply source 20 directly to the bowl of the toilet bowl 950. Hence, no water is drained from the water discharge port 412 of the nozzle unit 400.

As described above, according to this embodiment, each time water supply is stopped, the water left between the solenoid opening/closing valve 120 and the water discharge nozzle 410 is drained from the water discharge port 412 to the bowl of the toilet bowl 950, or directly to the bowl of the toilet bowl 950. On the other hand, the water left between the water supply source 20 and the solenoid opening/closing valve 120 is drained toward the water supply source 20 when the water pressure from the water supply source 20 becomes zero or negative. Thus, the sanitary washing device 10 can be drained in accordance with the presence or absence of water supply from outside. Furthermore, even after the power supply to the sanitary washing device 10 is stopped, drainage can be reliably performed.

In the case where a toilet bowl of the "vacuum type" is used, it is preferable to perform a step for automatically draining the water in the toilet bowl 950 after drainage to the toilet bowl 950.

Sixth Embodiment

Figure 23:
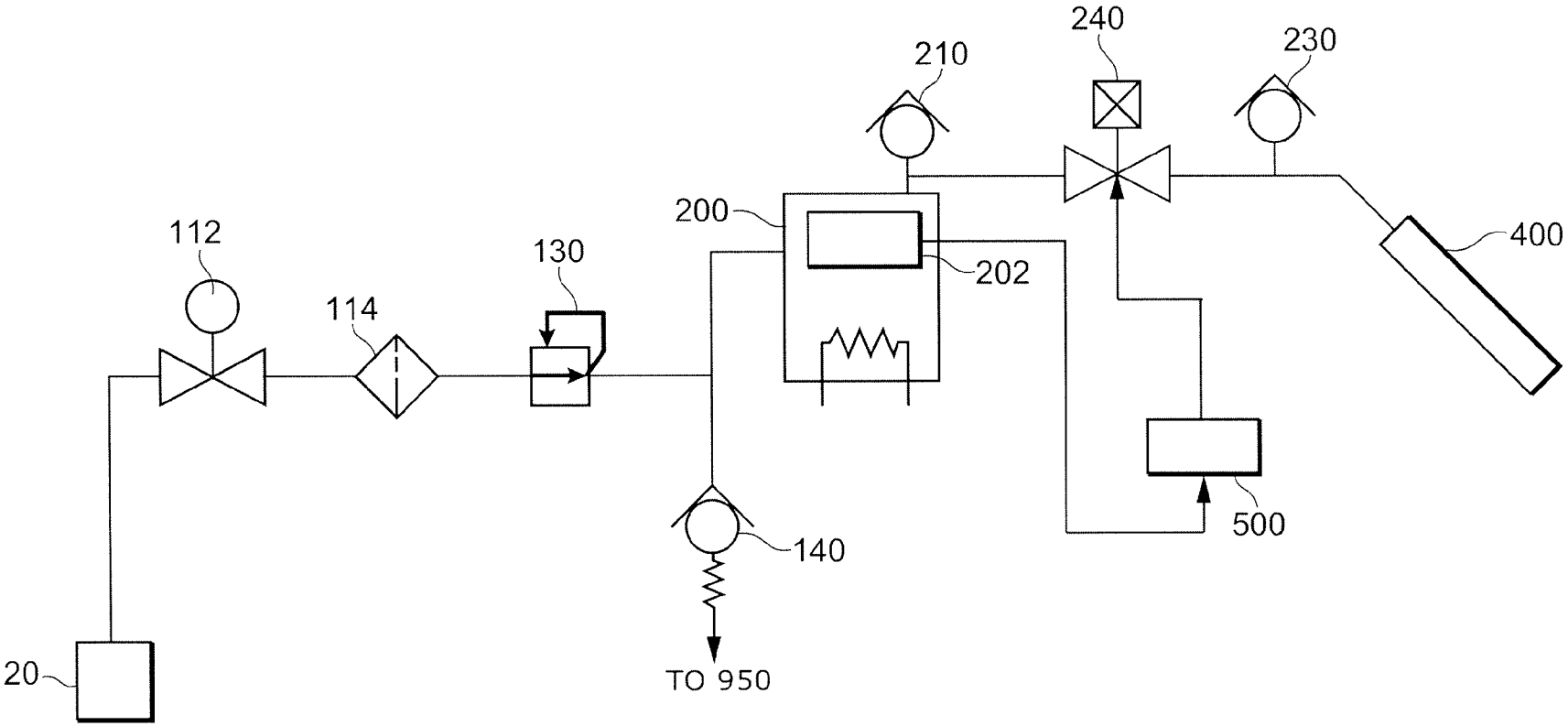
FIG. 23 is a block diagram showing the configuration of the water channel system of a sanitary washing device according to a sixth embodiment.

FIG. 23 is a block diagram showing the configuration of the water channel system of a sanitary washing device according to a sixth embodiment of the invention. The sanitary washing device 10 includes a channel connected to a water supply source 20, such as waterworks and water storage tank, and led to a nozzle unit 400. On the upstream side of the channel is first provided a water stopcock 112. The water stopcock 112 is manually openable/closable, and can shut off the water channel (flow channel) whenever necessary on such occasions as installation/removal and maintenance/inspection of the sanitary washing device 10. Here, the water stopcock 112 may be provided in the sanitary washing device 10, or may be provided on the supply port side of the water supply source 20, such as waterworks, as an element separate from the sanitary washing device 10.

Downstream of the water stopcock 112, a strainer 114 and a pressure regulator valve 130 are provided. The strainer 114 is illustratively a filter with approximately 80 mesh and removes foreign matter mixed in the supplied water. The pressure regulator valve 130 serves to regulate the water supply pressure, if it is high, to within a prescribed pressure range.

A safety valve 140 is provided downstream of the pressure regulator valve 130. The safety valve 140 is opened when the pressure of the water channel increases, and drains water to the bowl of the toilet bowl 950. The safety valve 140 thus provided can avoid water leakage inside the sanitary washing device 10 even if any failure of the pressure regulator valve 130, for instance, results in increasing the pressure of the water channel on its secondary side (downstream side). However, this safety valve 140 is not necessarily needed.

A heat exchange unit 200 is provided downstream of the safety valve 140. The heat exchange unit 200 heats the supplied water with a heater to turn it into warm water at a prescribed temperature. A water level detecting device 202 is provided inside the heat exchange unit 200. The water level detecting device 202 can detect the level of water in the heat exchange unit 200. Downstream of the heat exchange unit 200, vacuum breakers 210, 230, a normally closed opening/closing valve 240, and a nozzle unit 400 are connected. The vacuum breakers 210, 230 take in air from outside at the time of draining the water channel to facilitate draining the water channel between the heat exchange unit 200 and the nozzle unit 400. The normally closed opening/closing valve 240 controls supply of water in accordance with commands from a controlling section 500. Furthermore, the normally closed opening/closing valve 240 may regulate switching of water supply to the water discharge nozzle and nozzle cleaning chamber (see FIG. 26) provided in the nozzle unit 400, and adjustment of the force of water. A pulsator unit for pulsating water, for instance, may be provided on the secondary side of the normally closed opening/closing valve 240.

In this embodiment, the normally closed opening/closing valve 240 provided downstream of the heat exchange unit 200 serves as a control valve for controlling supply of water from the water supply source to the sanitary washing device 10. Hence, when the water pressure of the water supply source decreases to "0" or less, the water left on the primary side (upstream side) of the normally closed opening/closing valve 240 can be drained toward the water supply source 20. For instance, in the case where the heat exchange unit 200 is provided with a hot water storage tank, approximately 700 milliliters of water may be left. According to this embodiment, such residual water can be reliably and readily drained through the channel. Here, the invention is not limited to those provided with a hot water storage tank, but also encompasses those provided with a heat exchanger of the so-called instantaneous heating type.

The water left on the secondary side of the normally closed opening/closing valve 240 is drained as needed from the water discharge port of the nozzle unit 400, for instance, to the bowl of the toilet bowl 950.

Furthermore, the vacuum breakers 210, 230 provided on the primary side and secondary side, respectively, of the normally closed opening/closing valve 240 take in air to facilitate drainage.

Seventh Embodiment

Figure 24:
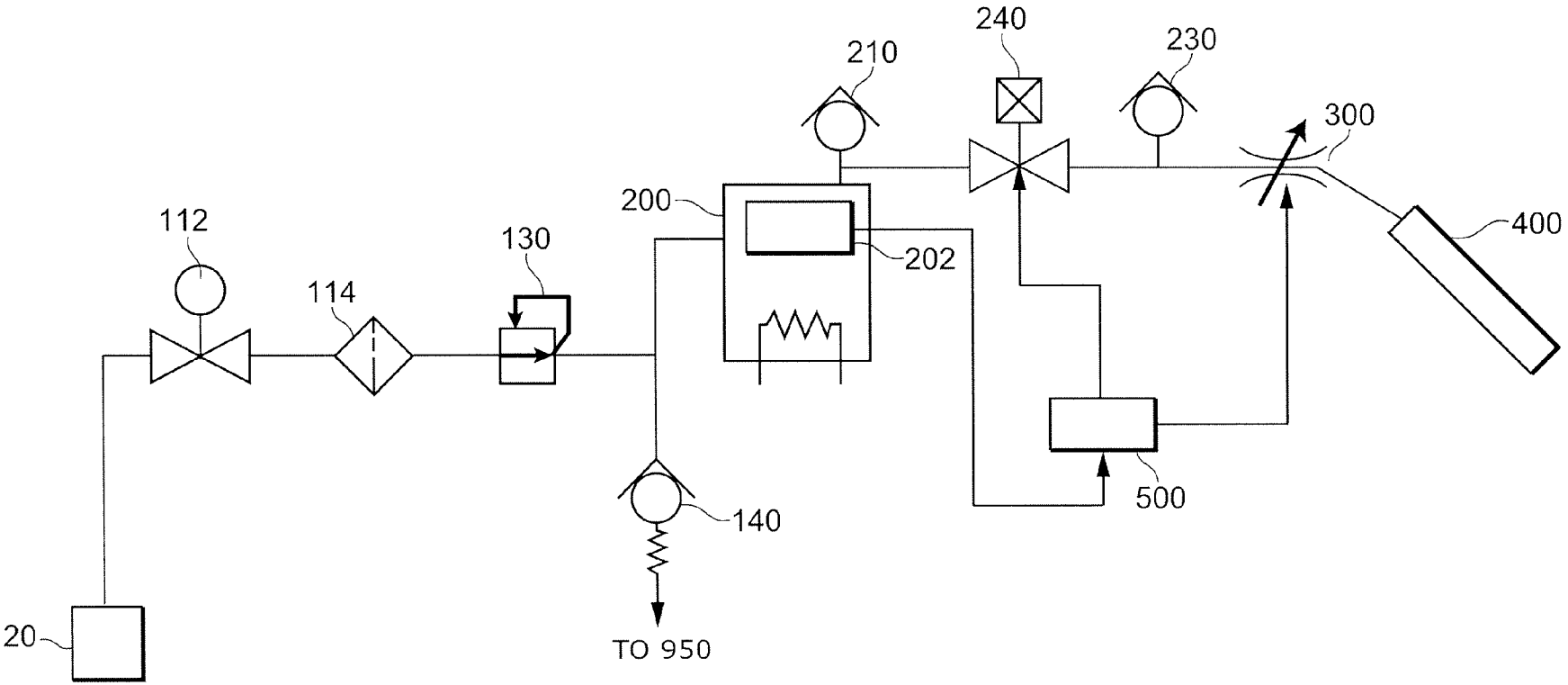
FIG. 24 is a block diagram showing the configuration of the water channel system of a sanitary washing device according to a seventh embodiment.

FIG. 24 is a block diagram showing the configuration of the water channel system of a sanitary washing device according to a seventh embodiment of the invention. The sanitary washing device 10 includes a channel connected to a water supply source 20, such as waterworks and water storage tank, and led to a nozzle unit 400. On the upstream side of the channel is first provided a water stopcock 112. The water stopcock 112 is manually openable/closable, and can shut off the water channel (flow channel) whenever necessary on such occasions as installation/removal and maintenance/inspection of the sanitary washing device 10. Here, the water stopcock 112 may be provided in the sanitary washing device 10, or may be provided on the supply port side of the water supply source 20, such as waterworks, as an element separate from the sanitary washing device 10.

Downstream of the water stopcock 112, a strainer 114 and a pressure regulator valve 130 are provided. The strainer 114 is illustratively a filter with approximately 80 mesh and removes foreign matter mixed in the supplied water. The pressure regulator valve 130 serves to regulate the water supply pressure, if it is high, to within a prescribed pressure range.

A safety valve 140 is provided downstream of the pressure regulator valve 130. The safety valve 140 is opened when the pressure of the water channel increases, and drains water to the bowl of the toilet bowl 950. The safety valve 140 thus provided can avoid water leakage inside the sanitary washing device 10 even if any failure of the pressure regulator valve 130, for instance, results in increasing the pressure of the water channel on its secondary side (downstream side). However, this safety valve 140 is not necessarily needed.

A heat exchange unit 200 is provided downstream of the safety valve 140. The heat exchange unit 200 heats the supplied water with a heater to turn it into warm water at a prescribed temperature. A water level detecting device 202 is provided inside the heat exchange unit 200. The water level detecting device 202 can detect the level of water in the heat exchange unit 200. Downstream of the heat exchange unit 200, vacuum breakers 210, 230, a normally closed opening/closing valve 240, a flow rate regulator valve unit 300, and a nozzle unit 400 are connected. The vacuum breakers 210, 230 take in air from outside at the time of draining the water channel to facilitate draining the water channel between the heat exchange unit 200 and the nozzle unit 400. The normally closed opening/closing valve 240 controls supply of water in accordance with commands from a controlling section 500. The flow rate regulator valve unit 300 regulates switching of water supply to the water discharge nozzle and nozzle cleaning chamber (see FIG. 26) provided in the nozzle unit 400, and adjustment of the force of water. A pulsator unit for pulsating water, for instance, may be provided on the secondary side of the normally closed opening/closing valve 240.

In this embodiment, the normally closed opening/closing valve 240 provided downstream of the heat exchange unit 200 serves as a control valve for controlling supply of water from the water supply source to the sanitary washing device 10. Hence, when the water pressure of the water supply source decreases to "0" or less, the water left on the primary side (upstream side) of the normally closed opening/closing valve 240 can be drained toward the water supply source 20. For instance, in the case where the heat exchange unit 200 is provided with a hot water storage tank, approximately 700 milliliters of water may be left. According to this embodiment, such residual water can be reliably and readily drained through the channel. Here, the invention is not limited to those provided with a hot water storage tank, but also encompasses those provided with a heat exchanger of the so-called instantaneous heating type.

The water left on the secondary side of the normally closed opening/closing valve 240 is passed through the flow rate regulator valve unit 300 and drained as needed from the water discharge port of the nozzle unit 400, for instance, to the bowl of the toilet bowl 950.

Furthermore, the vacuum breakers 210, 230 provided on the primary side and secondary side, respectively, of the normally closed opening/closing valve 240 take in air to facilitate drainage.

Eighth Embodiment

Figure 25:
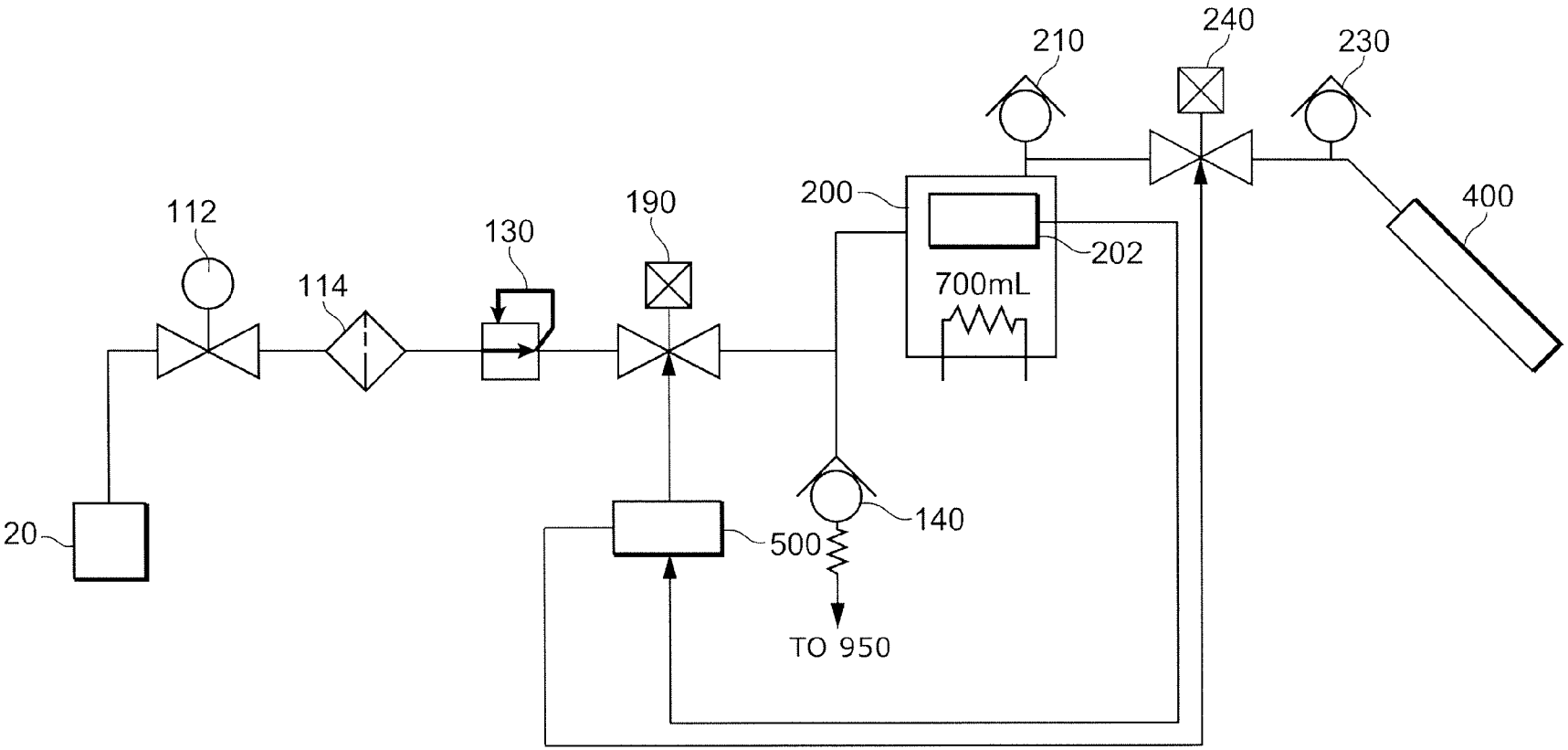
FIG. 25 is a block diagram showing the configuration of the water channel system of a sanitary washing device according to an eighth embodiment.

FIG. 25 is a block diagram showing the configuration of the water channel system of a sanitary washing device according to an eighth embodiment of the invention. The sanitary washing device 10 includes a channel connected to a water supply source 20, such as waterworks and water storage tank, and led to a nozzle unit 400. On the upstream side of the channel is first provided a water stopcock 112. The water stopcock 112 is manually openable/closable, and can shut off the water channel (flow channel) whenever necessary on such occasions as installation/removal and maintenance/inspection of the sanitary washing device 10. Here, the water stopcock 112 may be provided in the sanitary washing device 10, or may be provided on the supply port side of the water supply source 20, such as waterworks, as an element separate from the sanitary washing device 10.

Downstream of the water stopcock 112, a strainer 114, a pressure regulator valve 130, and a normally open opening/closing valve 190 are provided. The strainer 114 is illustratively a filter with approximately 80 mesh and removes foreign matter mixed in the supplied water. The pressure regulator valve 130 serves to regulate the water supply pressure, if it is high, to within a prescribed pressure range. The normally open opening/closing valve 190 is closed in accordance with a closing command from a controlling section 500.

A safety valve 140 is provided downstream of the normally open opening/closing valve 190. The safety valve 140 is opened when the pressure of the water channel increases, and drains water to the bowl of the toilet bowl 950. The safety valve 140 thus provided can avoid water leakage inside the sanitary washing device 10 even if any failure of the pressure regulator valve 130, for instance, results in increasing the pressure of the water channel on its secondary side (downstream side). However, this safety valve 140 is not necessarily needed.

A heat exchange unit 200 is provided downstream of the safety valve 140. The heat exchange unit 200 heats the supplied water with a heater to turn it into warm water at a prescribed temperature. A water level detecting device 202 is provided inside the heat exchange unit 200. The water level detecting device 202 can detect the level of water in the heat exchange unit 200. Downstream of the heat exchange unit 200, vacuum breakers 210, 230, a normally closed opening/closing valve 240, and a nozzle unit 400 are connected. The vacuum breakers 210, 230 take in air from outside at the time of draining the water channel to facilitate draining the water channel between the heat exchange unit 200 and the nozzle unit 400. The normally closed opening/closing valve 240 controls supply of water in accordance with commands from the controlling section 500. Furthermore, the normally closed opening/closing valve 240 regulates switching of water supply to the water discharge nozzle and nozzle cleaning chamber (see FIG. 26) provided in the nozzle unit 400, and adjustment of the force of water. A pulsator unit for pulsating water, for instance, may be provided on the secondary side of the normally closed opening/closing valve 240.

In this embodiment, the normally closed opening/closing valve 240 provided downstream of the heat exchange unit 200 serves as a control valve for controlling supply of water from the water supply source to the sanitary washing device 10. On the other hand, because the opening/closing valve 190 provided upstream of the heat exchange unit 200 is normally open, this valve is opened and allows passage of water as long as no closing command is issued from the controlling section 500. Hence, when the water pressure of the water supply source decreases to "0" or less, the water left on the primary side (upstream side) of the normally closed opening/closing valve 240 can be drained toward the water supply source 20. For instance, in the case where the heat exchange unit 200 is provided with a hot water storage tank, approximately 700 milliliters of water may be left. According to this embodiment, such residual water can be reliably and readily drained through the channel. Here, the invention is not limited to those provided with a hot water storage tank, but also encompasses those provided with a heat exchanger of the so-called instantaneous heating type.

The water left on the secondary side of the normally closed opening/closing valve 240 is drained as needed from the water discharge port of the nozzle unit 400, for instance, to the bowl of the toilet bowl 950.

Furthermore, the vacuum breakers 210, 230 take in air to facilitate drainage.

In the case where the normally closed opening/closing valve 240 has a flow rate regulating function for regulating the flow rate of wash water to be discharged from the nozzle unit, the degree of opening of the valve may be difficult to adjust if a large hydrostatic pressure is applied from the water supply source. In that case, when the flow rate is regulated, in response to a water discharge command from a manipulating device, not shown, the controlling section 500 can once close the normally open opening/closing valve 190 to perform flow rate regulation by the normally closed opening/closing valve 240. This facilitates flow rate regulation because a large hydrostatic pressure is not applied to the normally closed opening/closing valve 240. After the flow rate regulation is completed, the normally open opening/closing valve 190 can be opened to squirt wash water from the nozzle unit. Furthermore, in this embodiment, the normally open opening/closing valve is located on the primary side of the heat exchange unit 200. Hence, when the sanitary washing device is energized, the normally open opening/closing valve 190 can be forcibly closed, which can prevent the hydrostatic pressure of the water supply source from being constantly applied to the heat exchange unit 200.

Figure 26:
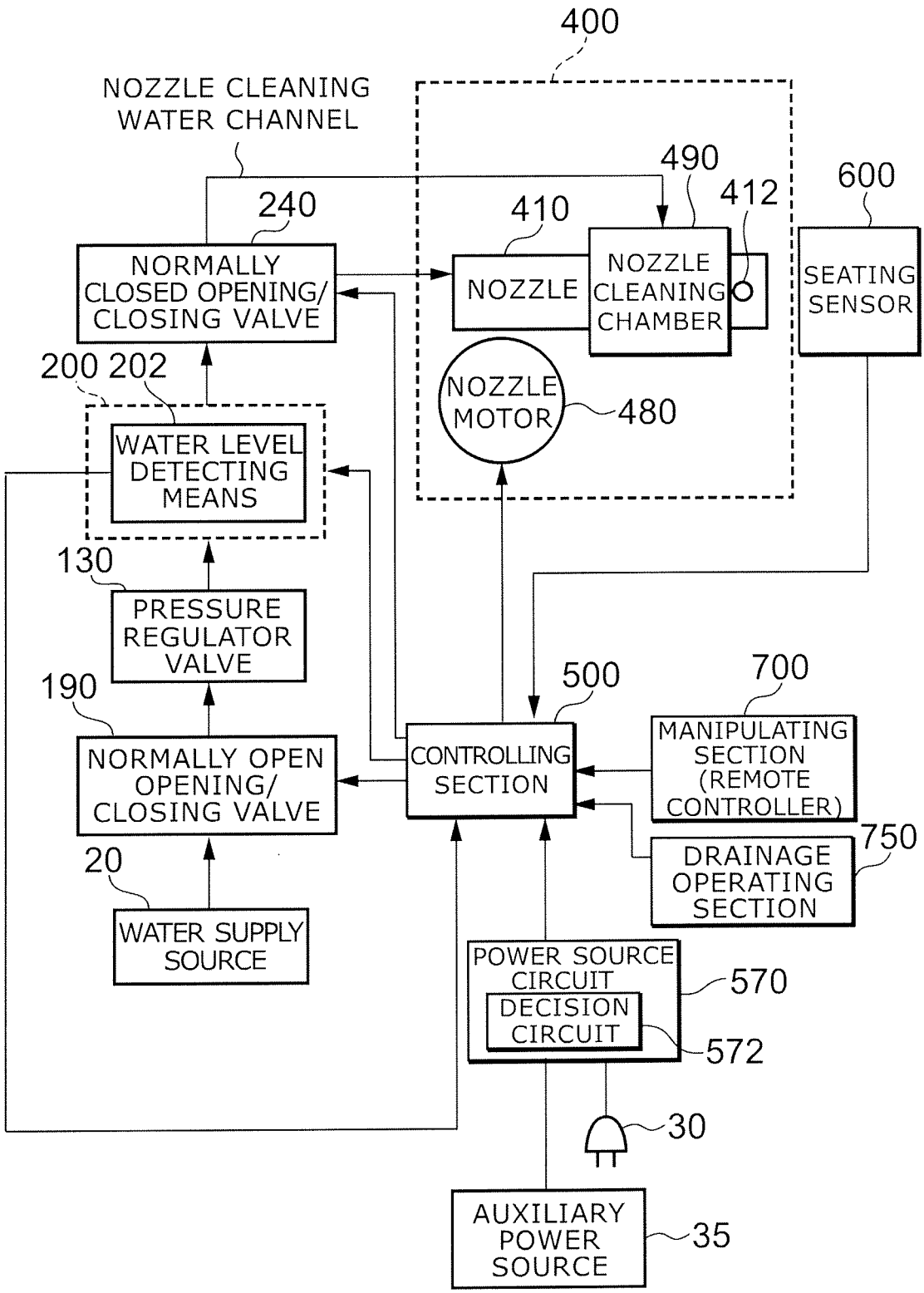
FIG. 26 is a block diagram of the sanitary washing device according to the eighth embodiment.

FIG. 26 is a block diagram of the sanitary washing device of the sixth to eighth embodiment. Here, the eighth embodiment is described as a representative. As described above with reference to FIG. 25, a normally open opening/closing valve 190, a pressure regulator valve 130, a heat exchange unit 200, vacuum breakers 210, 230, and a normally closed opening/closing valve 240 are provided in the channel connected to a water supply source 20 and led to a nozzle unit 400. A water level detecting device 202 for detecting water level in the heat exchange unit 200 can be provided as needed inside the heat exchange unit 200. The water level detecting device 202 transmits information on the water level in the heat exchange unit 200 to a controlling section 500.

The nozzle unit 400 includes a water discharge nozzle 410, a nozzle motor 480 for extending/retracting it, and a nozzle cleaning chamber 490 for squirting water to the outer periphery of the water discharge nozzle 410 to clean its body. The operation of these elements is controlled by the controlling section 500. The controlling section 500 receives as input, for instance, a signal from a seating sensor 600 for detecting that a user is seated on the toilet seat 14, and information of switch manipulation by a manipulating section (remote controller) 700 and the like.

This embodiment may include an auxiliary power source 35 and a decision circuit 572. The decision circuit 572 is provided illustratively inside a power source circuit 570. If power is supplied from the power source 30, the decision circuit 572 preferentially uses power supply from the power source 30 for the operation of the sanitary washing device 10. On the other hand, if the decision circuit 572 detects that power supply from the power source 30 is stopped from any cause, it switches to power supply from the auxiliary power source 35, and the power supply is used for the operation of the sanitary washing device 10.

According to the sixth to eighth embodiment described above, the water left in the water channel of the sanitary washing device 10 is drained toward the water supply source 20 when the water pressure of the water supply source 20 decreases to "0" or less. That is, water drainage can be performed using the existing water supply pipe without need of user's drainage operation and without need of providing a special drainage mechanism.

For instance, in cold climates, when water supply to the sanitary washing device 10 is stopped, or when water is drained for the purpose of avoiding freezing of the water supply source 20, drainage of the sanitary washing device 10 can be automatically performed in response to the decrease of water supply pressure. That is, the user does not need to purposely manipulate the water stop valve and the drain valve of the sanitary washing device. Thus, the embodiments can provide a user-friendly sanitary washing device.

Furthermore, for instance, when a camper, train, airplane or the like with the sanitary washing device installed therein is parked in a low-temperature environment, the water supply source is often stopped. According to the embodiments, even in such cases, drainage of the sanitary washing device can be automatically performed in response to the decrease of the water pressure of the water supply source. Hence, also in these cases, the user does not need to purposely manipulate the water stop valve and the drain valve of the sanitary washing device, but only needs to stop the water supply source. Thus, the embodiments can provide a user-friendly sanitary washing device.

The embodiments of the invention have been described with reference to examples. However, the invention is not limited to these examples. For instance, the features of the examples described above with reference to FIGS. 1 to 26 can be suitably combined with each other as long as technically feasible, and such combinations are also encompassed within the scope of the invention.

For instance, in the example shown in FIG. 7, 9, or 11, the connecting position of the second channel 150 can be modified as shown in FIG. 3, and such variations are also encompassed within the scope of the invention.

Furthermore, the structure of the sanitary washing device, and the content of its initializing operation are not limited to those described above with reference to FIGS. 1 to 26, but can be suitably modified in design by those skilled in the art to similarly practice the invention and achieve similar effects. Such modifications are also encompassed within the scope of the invention as long as they include the spirit of the invention. For instance, the water discharge nozzle 410 may be advanced/retracted by water pressure, or have a multi-stage structure which is slidable inside one or more cylinder bodies.

INDUSTRIAL APPLICABILITY

This invention can provide a sanitary washing device which can be drained in accordance with the presence or absence of water supply from outside.

The invention claimed is:

1. A sanitary washing device comprising:

a water discharge nozzle configured to squirt water from a water discharge port;

a first channel configured to guide water supplied from a water supply source to the water discharge nozzle;

a first channel opening/closing valve provided in the first channel and configured to control passage of water through the first channel;

a heat exchange unit provided in the first channel between the first channel opening/closing valve and the water discharge nozzle and configured to heat water passed therethrough; and a draining device configured to drain water in the heat exchange unit toward the water supply source, wherein the draining device includes:

a second channel coupling between the first channel on an upstream side of the first channel opening/closing valve and the first channel on a downstream side of the first channel opening/closing valve; and a second channel opening/closing valve provided in the second channel and configured to transition from a closed state to an open state in response to decrease in supply of water from the water supply source, and the second channel opening/closing valve is a pressure-responsive opening/closing valve configured to transition to a closed state upon receipt of water pressure of a first value or more from the first channel on the upstream side of the first channel opening/closing valve.

2. The sanitary washing device according to claim 1, further comprising:

a check valve provided in the first channel on a downstream side of the heat exchange unit and configured to block water from flowing from the water discharge nozzle to the heat exchange unit.

3. The sanitary washing device according to claim 1, further comprising:

a supply detecting section configured to detect supply of water from the water supply source; and a controlling section configured to stop operation of the heat exchange unit and the water discharge nozzle when, in accordance with a result of the detection outputted from the supply detecting section, the supply of water from the water supply source decreases.

4. The sanitary washing device according to claim 1, further comprising:

a water stop valve provided in the first channel between the heat exchange unit and the water discharge nozzle and being operable to stop water supply to the water discharge nozzle.

5. The sanitary washing device according to claim 1, further comprising:

a shutoff valve provided between the second channel opening/closing valve and the water discharge nozzle and being operable to transition to one of a closed state and an open state in accordance with a user's instruction.

6. The sanitary washing device according to claim 1, wherein the second channel opening/closing valve includes:

a housing including a first connection port connected to the upstream side of the first channel opening/closing valve, a second connection port connected to the downstream side of the first channel opening/closing valve, and an in-valve channel allowing the first connection port and the second connection port to communicate;

a pressure receiver housed in the housing and configured to receive water pressure in the in-valve channel at one major surface; and a main valve interlocked with the pressure receiver and supported in the housing so as to be able to shut off the in-valve channel, when water pressure applied to the first connection port increases, the pressure receiver receives water pressure, and the main valve interlocked therewith shuts off the in-valve channel, and when water pressure applied to the first connection port decreases, the main valve opens the in-valve channel.

7. The sanitary washing device according to claim 1, wherein the draining device includes:

a water pressure sensor provided in the first channel between the water supply source and the first channel opening/closing valve and configured to detect water pressure in the first channel; and a controlling section configured to control operation of the first channel opening/closing valve, and when the water pressure detected by the water pressure sensor is a prescribed value or less, the controlling section outputs a control signal for opening the first channel opening/closing valve.

8. The sanitary washing device according to claim 1, wherein the draining device includes:

a water pressure sensor provided in the channel between the water supply source and the first channel opening/closing valve and configured to detect water pressure in the first channel; and a controlling section configured to control operation of the first channel opening/closing valve, and when the water pressure detected by the water pressure sensor is a prescribed value or less and a drainage signal is received, the controlling section outputs a control signal for opening the first channel opening/closing valve.

9. The sanitary washing device according to claim 1, wherein the heat exchange unit is a heat exchange unit configured to instantaneously heat water passed therethrough, and the draining device includes:

a first pressure releasing device provided in the first channel between the water supply source and the first channel opening/closing valve; and a second pressure releasing device provided in the first channel between the first channel opening/closing valve and the heat exchange unit.

10. The sanitary washing device according to claim 1, wherein the first channel opening/closing valve is a normally open opening/closing valve, the sanitary washing device further comprising:

a normally closed opening/closing valve provided in the first channel between the heat exchange unit and the water discharge nozzle and configured to control passage of water through the first channel; and a controlling section configured to control operation of the normally closed opening/closing valve, and in response to a water discharge command, the controlling section opens the normally closed opening/closing valve to perform supply of water to the water discharging nozzle.

11. The sanitary washing device according to claim 10, wherein the normally closed opening/closing valve has a flow rate regulating function for regulating flow rate of wash water to be discharged from the water discharge nozzle, and in response to a water discharge command, the controlling section closes the first channel opening/closing valve and then performs the flow rate regulating function of the normally closed opening/closing valve, and after completion of flow rate regulation, the controlling section opens the first channel opening/closing valve to squirt the wash water from the water discharge nozzle.

* * * * *